US009966670B1

(12) United States Patent
Kuo et al.

(10) Patent No.: US 9,966,670 B1
(45) Date of Patent: May 8, 2018

(54) TRANSMITTING DEVICE AND RECEIVING DEVICE

(71) Applicant: INDUSTRIAL TECHNOLOGY RESEARCH INSTITUTE, Hsinchu (TW)

(72) Inventors: Fang-Yao Kuo, Taichung (TW); Che-Yang Chiang, Hsinchu (TW); Shih-Chieh Yen, Zhudong Township (TW); Wen-Chiang Chen, Hsinchu (TW)

(73) Assignee: INDUSTRIAL TECHNOLOGY RESEARCH INSTITUTE, Hsinchu (TW)

( * ) Notice: Subject to any disclaimer, the term of this patent is extended or adjusted under 35 U.S.C. 154(b) by 0 days. days.

(21) Appl. No.: 15/391,493

(22) Filed: Dec. 27, 2016

(30) Foreign Application Priority Data

Dec. 27, 2016 (TW) ..... 105143404 A

(51) Int. Cl.
*H01Q 13/10* (2006.01)
*H01Q 21/00* (2006.01)
(Continued)

(52) U.S. Cl.
CPC ..... *H01Q 21/0025* (2013.01); *H01Q 13/10* (2013.01); *H01Q 21/064* (2013.01); *H01Q 21/30* (2013.01)

(58) Field of Classification Search
CPC ..... H01Q 1/13; H01Q 21/30; H01Q 21/0025; H01Q 21/064
(Continued)

(56) References Cited

U.S. PATENT DOCUMENTS 6,421,021 B1 7/2002 Rupp et al.
6,822,615 B2 11/2004 Quan et al.
(Continued)

FOREIGN PATENT DOCUMENTS

CN 105703062 A 6/2016
CN 205723933 U 11/2016
(Continued)

OTHER PUBLICATIONS

Anonymous, "Lens (optics)," Wikipedia, the free encyclopedia, Dec. 29, 2016 (last modified Dec. 21, 2016), pp. 1-14.
(Continued)

*Primary Examiner* — Huedung Mancuso
(74) *Attorney, Agent, or Firm* — Birch, Stewart, Kolasch & Birch, LLP

(57) ABSTRACT

The present invention relates to a transmitting device and a receiving device. The transmitting device includes a controller, at least a feeding antenna and a plurality of transceiving modules. The controller generates a plurality of set of module control signals; the feeding antenna radiately transmits at least an internal transmission signal. Each transceiving module includes a plurality of transceiving units, and each transceiving unit includes a radiation slice and a transceiving circuit. A lengthwise edge of the radiation slice has a first end and a second end, and the first end and the second end of the lengthwise edge are toward an inner lateral side and an outer lateral side, respectively. The transceiving module performs transmission operation or reflection operation according to the module control signals.

20 Claims, 28 Drawing Sheets

(51) Int. Cl.
*H01Q 21/30* (2006.01)
*H01Q 21/06* (2006.01)

(58) Field of Classification Search
USPC ..... 343/770
See application file for complete search history.

(56) References Cited

U.S. PATENT DOCUMENTS

| | | | | |
|---|---|---|---|---|
| 7,446,601 | B2 | 11/2008 | LeChevalier | |
| 7,671,687 | B2 | 3/2010 | LeChevalier | |
| 7,728,772 | B2 | 6/2010 | Mortazawi et al. | |
| 8,248,320 | B2 | 8/2012 | Mason et al. | |
| 8,358,249 | B2 | 1/2013 | Toso et al. | |
| 9,888,391 | B2 * | 2/2018 | Ho | H04W 16/24 |
| 2006/0229103 | A1 * | 10/2006 | Monk | H04B 7/18506 455/562.1 |
| 2011/0250838 | A1 * | 10/2011 | Alexopoulos | H01Q 19/10 455/41.1 |
| 2012/0026998 | A1 * | 2/2012 | O'Keeffe | H01Q 1/246 370/338 |
| 2015/0288438 | A1 | 10/2015 | Maltsev et al. | |
| 2015/0289147 | A1 | 10/2015 | Lou et al. | |
| 2016/0315386 | A1 * | 10/2016 | Klemes | H01Q 3/34 |
| 2016/0360511 | A1 | 12/2016 | Barzegar et al. | |

FOREIGN PATENT DOCUMENTS

| | | | |
|---|---|---|---|
| TW | 201316615 | A1 | 4/2013 |
| WO | WO 2016/076614 | A1 | 5/2016 |

OTHER PUBLICATIONS

Cheng et al., "Study of 2-bit Antenna-Filter-Antenna Elements for Reconfigurable Millimeter-Wave Lens Arrays," IEEE Transactions on Microwave Theory and Techniques, vol. 54, No. 12, Dec. 2006, pp. 4498-4506.

Costa et al., "Compact Beam-Steerable Lens Antenna for 60-GHz Wireless Communications," IEEE Transactions of Antennas and Propagation, vol. 57, No. 10, Oct. 7, 2009 (first published Aug. 4, 2009), pp. 2926-2933.

Harvey et al., "Spatial Power Combining for High-Power Transmitters," Microwave, Dec. 2000, pp. 48-59.

Imbert et al., "Design and Performance Evaluation of a Dielectric Flat Lens Antenna for Millimeter-Wave Applications," IEEE Antennas and Wireless Propagation Letters, vol. 14, Feb. 4, 2015 (first published Oct. 15, 2014), pp. 342-345.

Kaouach et al., "X-Band Transmit-Arrays with Linear and Circular Polarization," European Conference on Antennas and Propagation 2010, Barcelona, Apr. 12-16, 2010, 5 pages.

Popović et al., "Quasi-Optical Transmit/Receive Front Ends," IEEE Transactions on Microwave Theory and Techniques, vol. 46, No. 11, Nov. 1998, pp. 1964-1975.

Porter et al., "Dual-Polarized Slot-Coupled Patch Antennas on Duroid with Teflon Lenses for 76.5 GHz Automotive Radar Systems," IEEE Transactions on Antennas and Propagation, vol. 47, No. 12, Dec. 1999, pp. 1836-1842.

Remez et al., "Dual-Polarized Tapered Slot-Line Antenna Array Fed by Rotman Lens Air-Filled Ridge-Port Design," IEEE Antennas and Wireless Propagation Letters, vol. 8, Aug. 4, 2009 (first published Jun. 10, 2009), pp. 847-851.

Remez et al., "Dual-Polarized Wideband Widescan Multibeam Antenna System From Tapered Slotline Elements Array," IEEE Antennas and Wireless Propagation Letters, vol. 4, 2005, pp. 293-296.

Schulwitz et al., "A Compact Dual-Polarized Multibeam Phased-Array Architecture for Millimeter-Wave Radar," IEEE Transactions on Microwave Theory and Techniques, vol. 53, No. 11, Nov. 2005, pp. 3588-3594.

Taiwanese Office Action and Search Report issued in Taiwanese Application No. 105143404, dated Aug. 15, 2017.

* cited by examiner

TRANSMITTING DEVICE AND RECEIVING DEVICE

CROSS-REFERENCE TO RELATED APPLICATION

This application claims the benefit of Taiwan application Serial No. 105143404, filed Dec. 27, 2016, the disclosure of which is incorporated by reference herein in its entirety.

TECHNICAL FIELD

The present disclosure relates to a transmitting device and a receiving device using multiple transceiving modules.

BACKGROUND

With rapid growth of wireless communication information quantity, demand for communication quality becomes stricter. The 5th generation mobile networks (5G) of the wireless communication technologies meet the operation requirements of high rate, high capacity and high quality. Since the current available bands in spectrum are highly congested, applications turn toward higher-frequency bands (>6 GHz). In these bands, the bandwidth for a single system is wider (e.g. about 500 MHz to 2 GHz), and data transmission capacity and system efficiency are increased. To ensure transmission quality of wireless communication signals, high gain antennas are used to transmit wireless communication signals in the prior arts.

Please refer to FIG. 1A, a schematic diagram illustrating a communication device which transmits wireless communication signals in a low-frequency band and utilizes a high gain antenna In order to transmit the signals to a wider range, a communication device 13 using a low-frequency band (e.g. 3G band) to transmit the wireless communication signals will utilize an radiating antenna 13*b* with a greater transmit power. A controller controls a base band processor 11 and a radio frequency (hereinafter, RF) circuit 13*a* to generate transmission signals which are then emitted into air through the radiating antenna 13*b*. However, the antenna 13*b* with greater transmit power usually generates a lot of heat and increases temperature of the communication device 13.

Due to factors of higher path loss, lower penetration and higher noise in the 5G band, higher power is required for the a transmitting device to transmit the wireless communication signals in the 5G band. As mentioned above, a radiating antenna 13*b* with higher transmit power will generate more heat so as to affect the performance of the communication device. Hence, the communication device 13 in FIG. 1A is not proper for the 5G band. Another conventional communication device takes advantage of multiple radiating antennas with lower transmit power.

Please refer to FIG. 1B, a schematic diagram illustrating a communication device utilizing multiple antennas with low power gains. The communication device 17 includes a plurality of radiating antennas 17*b* with lower power, a base band processor 15 and an RF circuit 17*a*. The antennas 17*b* in this application should be used with a plurality of amplifiers. The power gain of the amplifiers can assist the communication device 17 to enhance the transmission of the wireless communication signals.

Nevertheless, while using the multiple radiating antennas 17*b* with lower transmit power, the communication device 17 occupies larger space and further space is required for installation. In some conditions for installation the communication device, the installation space is insufficient for the bulky communication device 17.

SUMMARY

The present invention is directed to a transmitting device and a receiving device. The transmitting device and the receiving device include a controller, at least a feeding antenna and a plurality of transceiving modules. The controller controls the transceiving modules to perform transmission operation, reception operation or reflection operation, respectively. Arrangement of the transceiving modules may be arbitrarily adjusted.

According to a first embodiment of the present invention, a transmitting device is provided and including: at least a feeding antenna for radiately transmitting at least an internal transmission signal; a controller electrically connected to the at least a feeding antenna, for generating a plurality of first module control signals and a plurality of second module control signals, and feeding the at least an internal transmission signal into the at least a feeding antenna; a first transceiving module electrically connected to the controller, for performing first transmission operation in response to the first module control signals, wherein the first transceiving module includes: a first inner lateral side; a first outer lateral side parallel to the first inner lateral side wherein a distance between the first inner lateral side and the at least a feeding antenna is shorter than a distance between the first outer lateral side and the at least a feeding antenna; and a plurality of first transceiving units, each of the first transceiving units including: a first radiation slice having a first lengthwise edge wherein a first end and a second end of the first lengthwise edge are toward the first inner lateral side and the first outer lateral side, respectively, and the first radiation slice radiately receives the at least an internal transmission signal at the first end of the first lengthwise edge; and a first transceiving circuit disposed on the first radiation slice and electrically connected to the controller wherein the first transceiving circuit receives the at least an internal transmission signal from the first radiation slice, generates a first external transmission signal according to the at least an internal transmission signal, and radiately transmits the first external transmission signal through the second end of the first lengthwise edge of the first radiation slice; and a second transceiving module electrically connected to the controller, for performing one of second transmission operation and reflection operation in response to the second module control signals, wherein the second transceiving module includes: a second inner lateral side; a second outer lateral side parallel to the second inner lateral side wherein a distance between the second inner lateral side and the at least a feeding antenna is shorter than a distance between the second outer lateral side and the at least a feeding antenna; and a plurality of second transceiving units, each of the second transceiving units including: a second radiation slice having a second lengthwise edge equal in length to the first lengthwise edge wherein a first end and a second end of the second lengthwise edge are toward the second inner lateral side and the second outer lateral side, respectively, and the second radiation slice radiately receives the at least an internal transmission signal at the first end of the second lengthwise edge; and a second transceiving circuit disposed on the second radiation slice and electrically connected to the controller, for receiving the at least an internal transmission signal from the second radiation slice.

According to a second embodiment of the present invention, a receiving device is provided and including: at least a feeding antenna for radiately receiving a first internal reception signal and a second internal reception signal; a controller electrically connected to the at least a feeding antenna, for generating a plurality of first module control signals and a plurality of second module control signals, and receiving the first internal reception signal and the second internal reception signal from the at least a feeding antenna; a first transceiving module electrically connected to the controller, for performing first reception operation in response to the first module control signals, wherein the first transceiving module includes: a first inner lateral side; a first outer lateral side parallel to the first inner lateral side wherein a distance between the first inner lateral side and the at least a feeding antenna is shorter than a distance between the first outer lateral side and the at least a feeding antenna; and a plurality of first transceiving units, each of the first transceiving units including: a first radiation slice having a first lengthwise edge wherein a first end and a second end of the first lengthwise edge are toward the first inner lateral side and the first outer lateral side, respectively, and the first radiation slice radiately receives a first external reception signal at the second end of the first lengthwise edge; and a first transceiving circuit disposed on the first radiation slice and electrically connected to the controller wherein the first transceiving circuit receives the first external reception signal from the first radiation slice, generates the first internal reception signal according to the first external reception signal, and radiately transmits the first internal reception signal through the first end of the first lengthwise edge of the first radiation slice; and a second transceiving module electrically connected to the controller, for performing one of second reception operation and reflection operation in response to the second module control signals, wherein the second transceiving module includes: a second inner lateral side; a second outer lateral side parallel to the second inner lateral side wherein a distance between the second inner lateral side and the at least a feeding antenna is shorter than a distance between the second outer lateral side and the at least a feeding antenna; and a plurality second transceiving units, each of the second transceiving units including: a second radiation slice having a second lengthwise edge equal in length to the first lengthwise edge wherein a first end and a second end of the second lengthwise edge are toward the second inner lateral side and the second outer lateral side, respectively, and the second radiation slice radiately transmits the second internal reception signal at the first end of the second lengthwise edge; and a second transceiving circuit disposed on the second radiation slice and electrically connected to the controller wherein the second transceiving circuit feeds the second internal reception signal into the second radiation slice.

To better understand the aforementioned aspect and other aspects of the present invention, preferred embodiments are provided by the following detailed description and accompanying drawings, in which:

DRAWINGS

DETAILED DESCRIPTION

On condition that transmission quality of the wireless transmission signals is maintained, the present invention proposes that multiple transceiving modules are used to both lower power of the radiating antenna and decrease space occupied. In the communication device, the quantity of the transceiving module(s), the quantity of the transceiving units in one transceiving module and the arrangement of the transceiving module(s) can be adjusted to meet practical requirements. The transceiving module includes multiple transceiving units with low gain and wideband property. Each transceiving unit further includes a radiation slice and a transceiving circuit cooperating with each other. The transceiving units can perform transmission operation, reception operation or reflection operation.

The present disclosure can ensure certain coverage of the field of view of the communication device and generate sufficient equivalent isotropically radiated power (EIRP) to perform long-distance communication. For illustration purposes, the following description mainly describes transmission function of the communication device (that is, functioning as a transmitting device), but the communication device perform reception function (that is, receiving device).

Figure 1A:
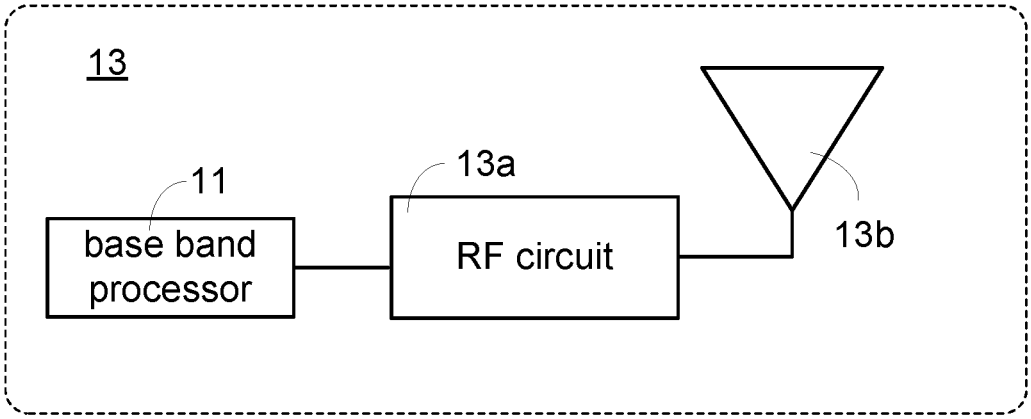
FIG. 1A (PRIOR ART)
FIG. 1A (prior art) is a schematic diagram illustrating a communication device utilizing a high gain antenna.
Figure 1B:
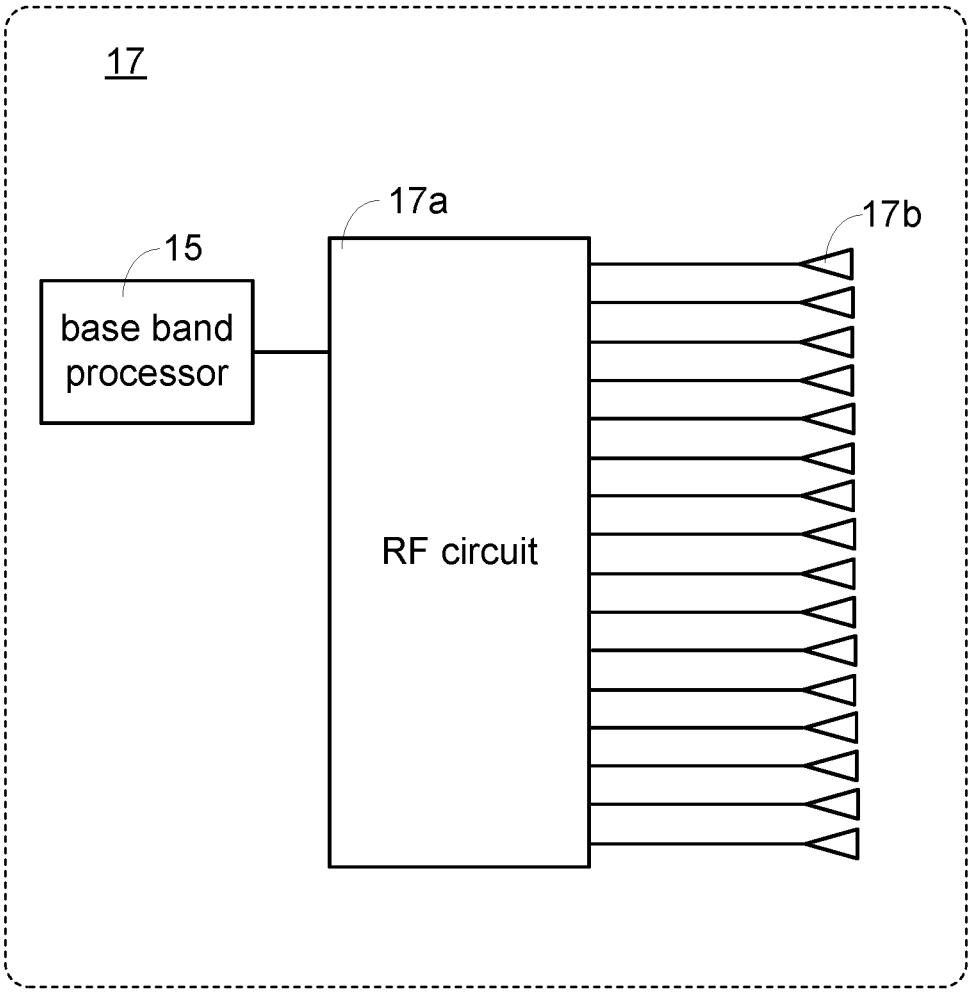
FIG. 1B (PRIOR ART)
FIG. 1B (prior art) is a schematic diagram illustrating a communication device utilizing multiple antennas with low power gains.
Figure 2A:
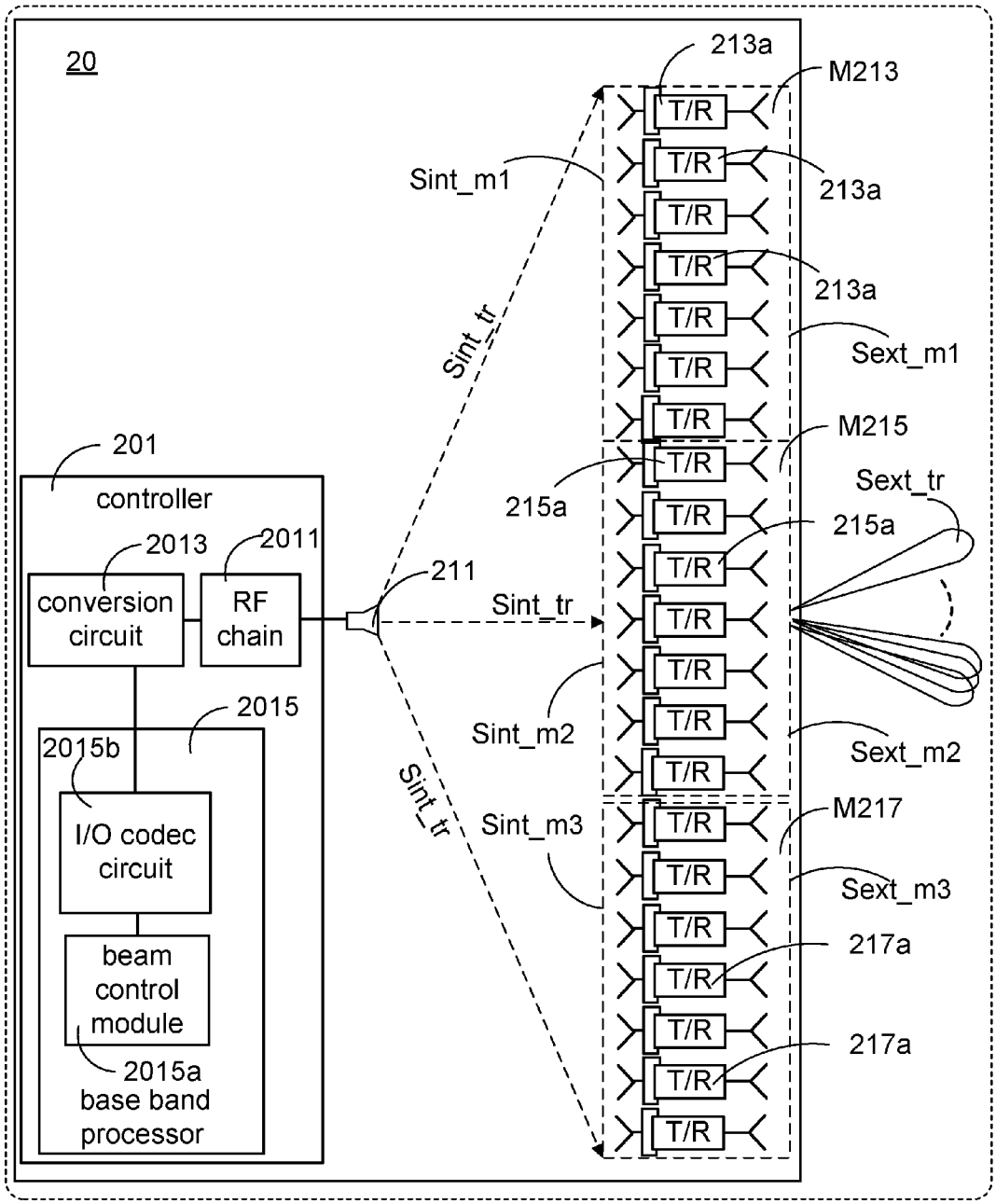
FIG. 2A is a schematic diagram illustrating a communication device having three transceiving modules arranged in a line.

Please refer to FIG. 2A, a schematic diagram illustrating a communication device having three transceiving modules. The communication device 20 includes a controller 201, a feeding antenna 211 and transceiving modules M213, M215, M217. The transceiving module M213 includes a plurality of transceiving units 213*a*. The transceiving units 213*a* are arranged in parallel wherein one end of each transceiving unit 213*a* is toward an inner lateral side Sint_m1 of the transceiving module 213, and the other end is toward an outer lateral side Sext_m1 of the transceiving module M213. Similarly, the transceiving units 215*a*, 217*a* of the transceiving modules M215, M217 are arranged in parallel. Two ends of each transceiving unit 215*a* are toward an inner lateral side Sint_m2 and an outer lateral side Sext_m2 of the transceiving module M215, respectively. Two ends of each transceiving unit 217*a* are toward an inner lateral side Sint_m3 and an outer lateral side Sext_m3 of the transceiving module M217, respectively. Although the transceiving modules M213, M215, M217 are arranged in a line in the embodiment, the concepts of the present disclosure are not limited to this.

In FIG. 2A, the controller 201 includes a base band processor 2015, an RF chain 2011 and a conversion circuit 2013. The conversion circuit 2013 includes an analog to digital converter (A/D) and a digital to analog converter (D/A). The base band processor 2015 further includes a beam control module 2015*a* and an input/output (I/O) codec circuit 2015*b* electrically connected to each other. The I/O codec circuit 2015*b* is configured to generate data contents to be transmitted. The beam control module 2015*a* generates module control signals corresponding to the transceiving modules M213, M215, M217 according to the use and transmission direction of the wireless communication signals.

The conversion circuit 2013 is electrically connected to the base band processor 2015, and the RF chain 2011 is electrically connected between the feeding antenna 211 and the conversion circuit 2013. After the I/O codec circuit 2015*b* generates the data contents to be transmitted, transmission signals are generated by conversion through the conversion circuit 2013 and the RF chain 2011. Then, after the RF chain 2011 feeds the transmission signals into the feeding antenna 211, the feeding antenna 211 radiately transmits internal transmission signal Sint_tr into air. Next, the transceiving modules M213, M215, M217 receive the internal transmission signals Sint_tr through the transceiving units 213*a*, 215*a*, 217*a* and convert the internal transmission signals Sint_tr into external transmission signals Sext_tr. After the transceiving modules M213, M215, M217 convert the internal transmission signals Sint_tr into the external transmission signals Sext_tr, the external transmission signals Sext_tr are radiately transmitted out from the transceiving modules M213, M215, M217.

Figure 2B:
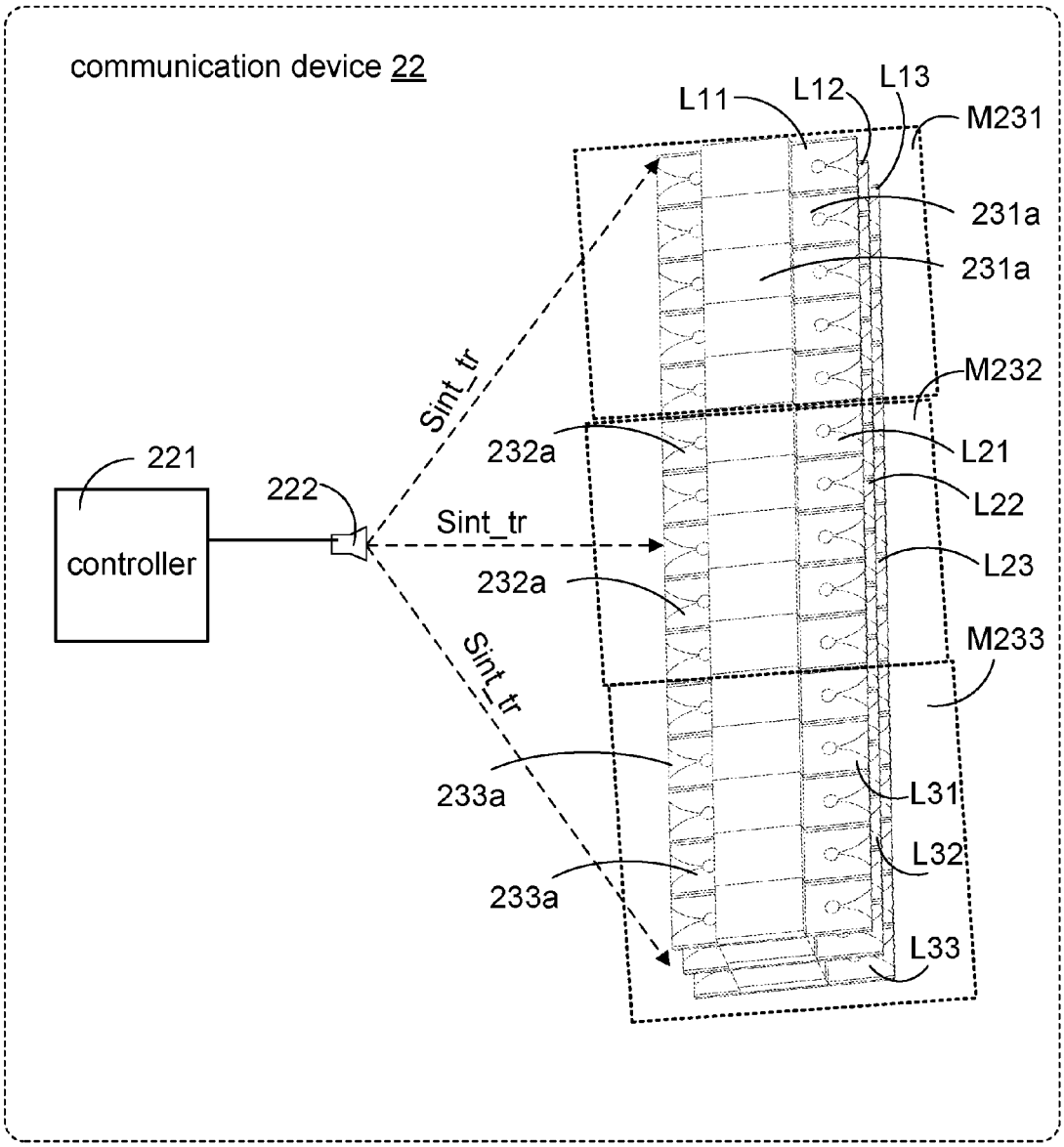
FIG. 2B is a schematic diagram illustrating that the transceiving modules include multiple rows of transceiving units.

FIG. 2B is a schematic diagram illustrating that the transceiving modules include multiple rows of transceiving units. In this diagram, the communication device 22 also includes three transceiving modules M231, M232, M233, and each transceiving module includes multiple rows of transceiving units. The controller 221 radiately transmits the internal transmission signal Sint_tr to the transceiving modules M231, M232, M233 through the feeding antenna 222. In this diagram, it is assumed that the transceiving units 231*a*, 232*a*, 233*a* of each transceiving module M231, M232, M233 are arranged in three rows (L11, L12, L13), (L21, L22, L23), (L31, L32, L33), and each row includes five transceiving units 231*a*, 232*a*, 233*a*. The row number of the transceiving units included in the transceiving modules may be different in practice.

Figure 3:
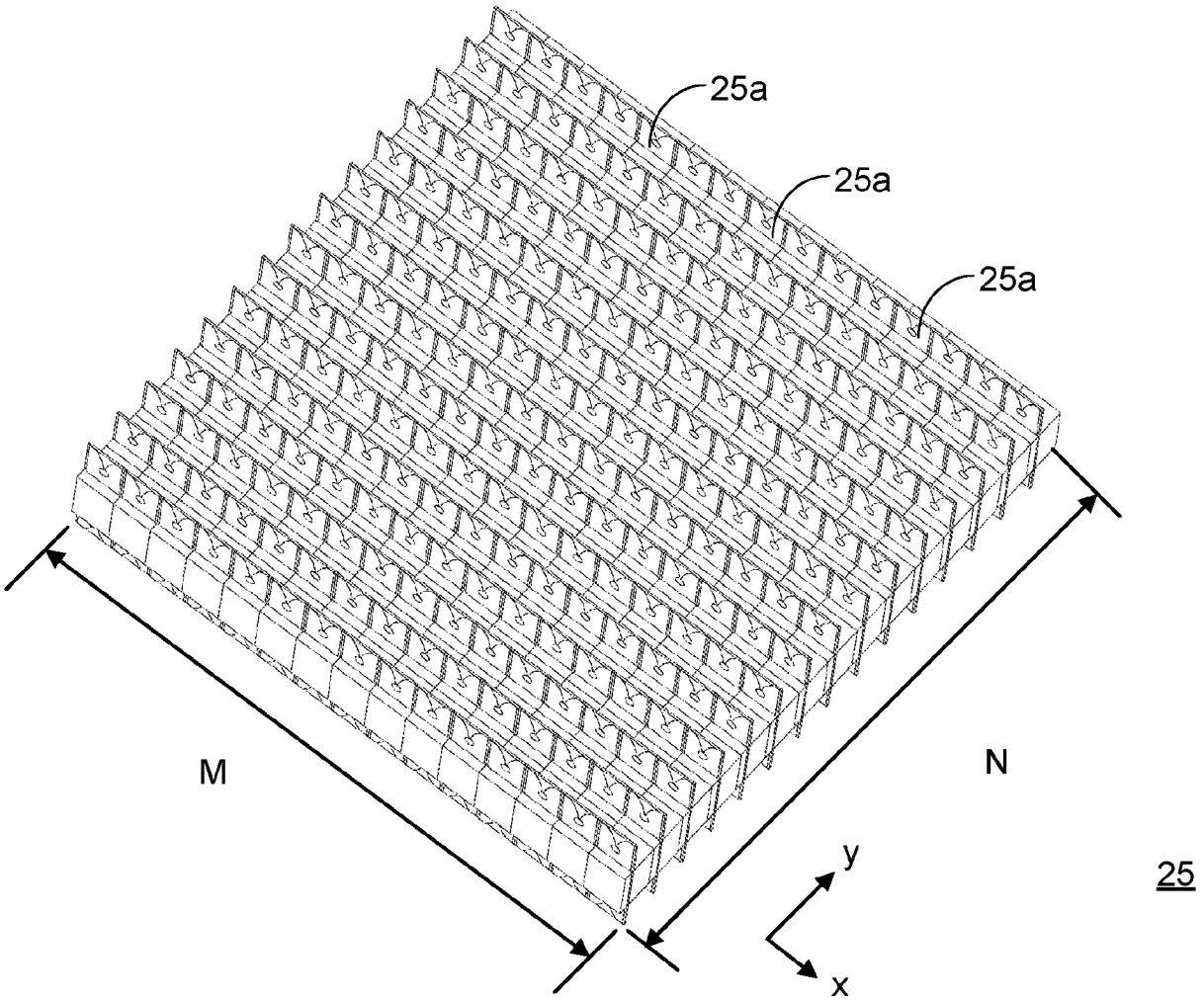
FIG. 3 is a top view illustrating the transceiving units of the transceiving modules arranged in an array.

Please refer to FIG. 3, a top view illustrating the transceiving units of the transceiving modules arranged in an array. In this diagram, it is assumed that the transceiving module 25 includes M columns and N rows of transceiving units 25*a*, the row direction is parallel to the x-axis, and the column direction is parallel to the y-axis. If the transceiving module 25 includes a plurality of transceiving units 25*a*, the controller should perform the control according to the relative position of the respective transceiving unit 25*a* in the transceiving module 25.

Figure 4:
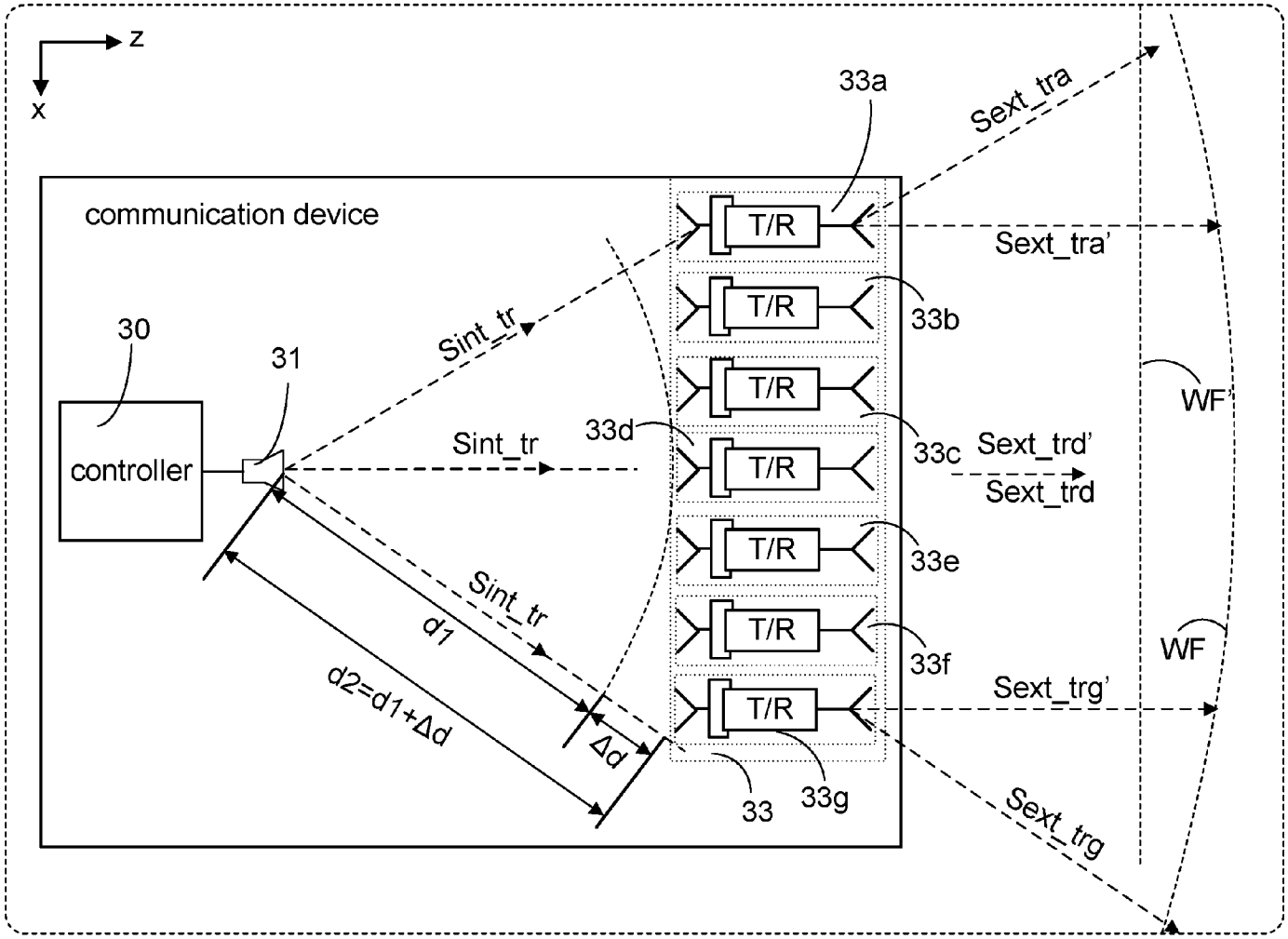
FIG. 4 is a schematic diagram illustrating that the controller transmits the internal transmission signals to the feeding antenna and the feeding antenna transmits the internal transmission signals to the transceiving module.

Please refer to FIG. 4, a schematic diagram illustrating that the controller transmits the internal transmission signal to the feeding antenna and the feeding antenna transmits the internal transmission signal to the transceiving unit module. In this diagram, the feeding antenna 31 may be an individual antenna or an antenna array, and the transceiving module 33 further includes a plurality of transceiving units 33*a*~33*g*.

When the controller 30 transmits the internal transmission signal Sint_tr to the transceiving module 43 through the feeding antenna 31, the time points when the transceiving units 33*a*~33*g* actually receive the internal transmission signals Sint_tr are not exactly identical because relative distances between the feeding antenna 31 and the transceiving units 33*a*~33*g* are not identical. For example, the relative distance d1 between the feeding antenna 31 and the transceiving unit 33*d* is shorter than the relative distance d2 between the feeding antenna 31 and the transceiving unit 33*g*. There is a difference Δd between the relative distance d2 and the relative distance d1 (that is, d2=d1+Δd).

In other words, when the internal transmission signal Sint_tr is transmitted from the feeding antenna 31 to the transceiving unit 33*g* near the edge, the internal transmission signal Sint_tr should travel an additional distance Δd. If the transceiving units 33*a*~33*g* transform the internal transmission signals Sint_tr into the external transmission sub-signals Sext_tra~Sext_trg immediately after the transceiving units 33*a*~33*g* receive the corresponding internal transmission signals Sint_tr, the transceiving unit 33*d* at the center of the transceiving module 33 receives the internal transmission signal Sint_tr, and generates and transmits the external transmission sub-signal Sext_trd first. On the other hand, the transceiving units 33*a*, 33*g* at the edges of the transceiving module 33 receive the internal transmission signals Sint_tr, and generate and transmit the external transmission sub-signals Sext_tra, Sext_trg last. Hence, the wavefront of the external transmission signal Sext_tr which consists of the external transmission sub-signals Sext_tra~Sext_trg and are transmitted from the transceiving module 33 has a spherical surface (spherical wavefront WF). In this way, the time points when a remote receiving device actually receives the external transmission sub-signals Sext_tra~Sext_trg are different.

To improve the above-mentioned device, the controller 30 of the present disclosure can independently control the transceiving units 33*a*~33*g* according to the relative positions of the transceiving units 33*a*~33*g* in the transceiving module 33. By the control with the controller 30, the transceiving units 33*a*~33*g* receive the internal transmission signals Sint_tr and then perform different conversion of the internal transmission signals Sint_tr to form the output external transmission signals Sext_tra'~Sext_trg' with a plane wavefront WF'

Figure 5:
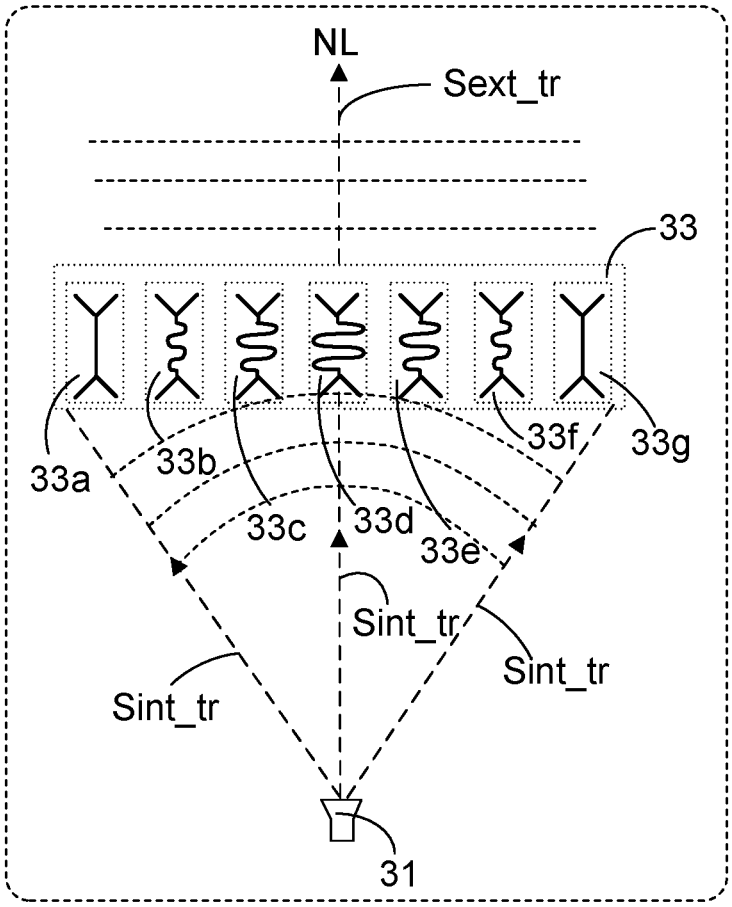
FIG. 5 is a schematic diagram illustrating that transmission paths of the internal transmission signals in the transceiving units are adjusted so that the external transmission signals with the plane wavefront are transmitted out from the transceiving module.

Please refer to FIG. 5, a schematic diagram illustrating that transmission paths of the internal transmission signals in the transceiving units are adjusted so that the external transmission signals with the plane wavefront are transmitted out from the transceiving module. According to the concepts of the present disclosure, after the feeding antenna 31 transmits the internal transmission signal Sint_tr to the transceiving module 33, the transceiving units 33*a*~33*g* adjust the transmission paths of the received internal transmission signals Sint_tr, respectively.

For example, the transceiving units 33*a*, 33*g* at the edges receive the internal transmission signals Sint_tr at a later time point. Therefore, after the transceiving units 33*a*, 33*g* receive the internal transmission signals Sint_tr, the internal transmission signals Sint_tr are transformed into the external transmission signals Sext_tr immediately. On the other hand, the transceiving unit 33*d* at the center receives the internal transmission signal Sint_tr at the earliest time point and should wait until other transceiving units 33*a*~33*c*, 33*e*~33*g* receive the internal transmission signals Sint_tr. Therefore, after the transceiving unit 33*d* receives the internal transmission signal Sint_tr, a longer curved path is provided for the received internal transmission signal to retard the generation of the external transmission signal Sext_tr. Similarly, the retardation of the internal transmission signals Sint_tr which are transmitted by the transceiving units 33*c*, 33*e* near the center is greater than the retardation of the internal transmission signals Sint_tr which are transmitted by the transceiving units 33*b*, 33*f* near the edges. Hence, the external transmission signals Sext_tr with the plane wavefront are transmitted out from the transceiving module 33. For example, the wavefront moves along the normal direction NL as indicated in FIG. 5. The description about that the controller controls the above-mentioned phase delays according to the positions of the transceiving units in the transceiving module will be described with reference to FIG. 6.

Figure 6:
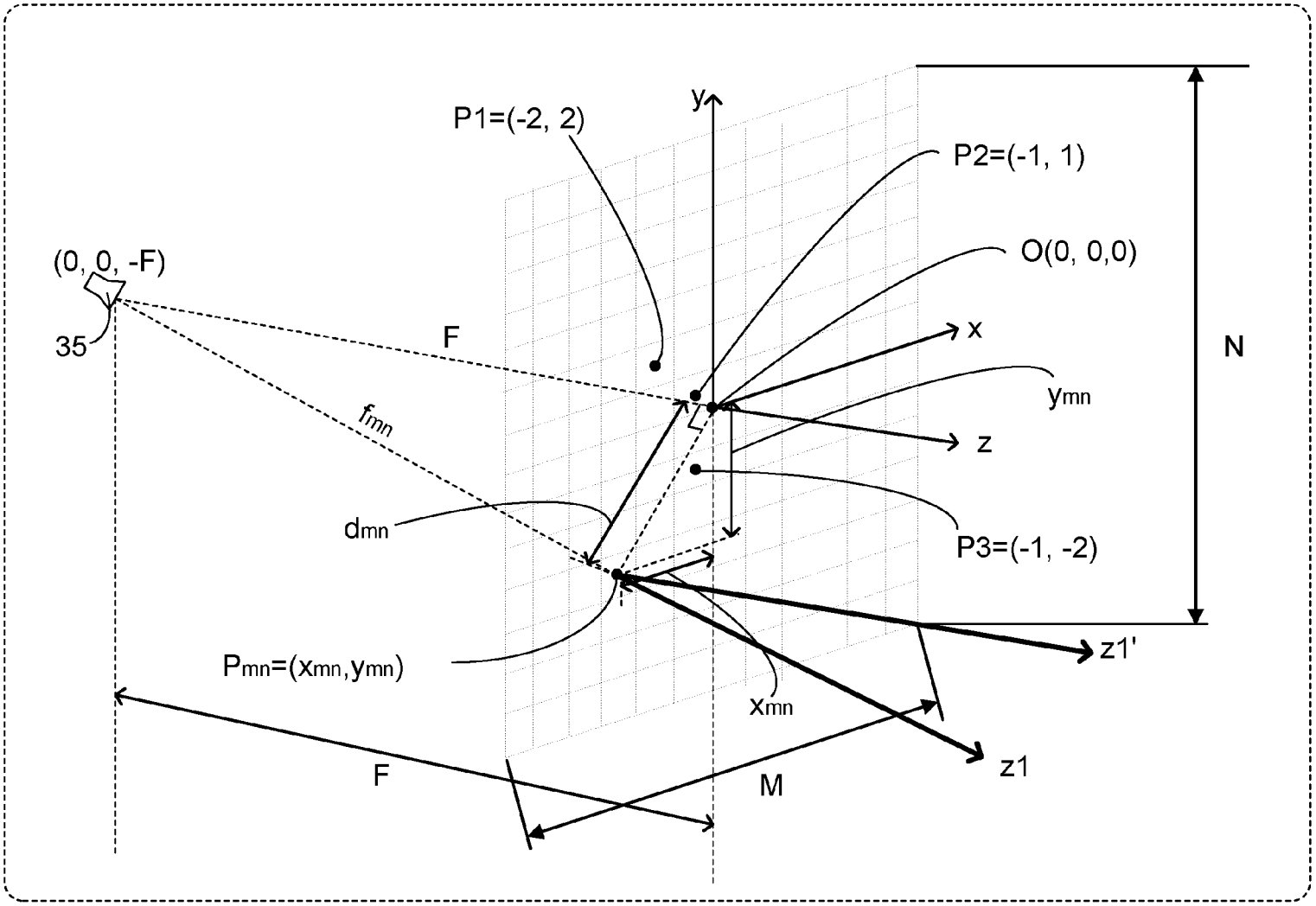
FIG. 6 is a schematic diagram illustrating that the phases of the signals corresponding to the transceiving units are controlled according to the positions of the transceiving units at a transceiving unit plane.

Please refer to FIG. 6, a schematic diagram illustrating that the phases of the signals corresponding to the transceiving units are controlled according to the positions of the transceiving units at a transceiving unit plane. The grid represents the arrangement of the transceiving units in the transceiving module. That is to say, each square corresponds to one transceiving unit. The marks in FIG. 3 are used herein, and it is assumed that there are M columns of transceiving units crossing the x-axis and N rows of transceiving units crossing the y-axis.

In FIG. 6, the origin O (the coordinates (0,0,0)) is set at the center of the transceiving module, and the coordinates of the feeding antenna 35 are (0,0,-F). In other words, the feeding antenna 35 is positioned at a negative side of the z-axis, and a distance between the feeding antenna 35 and the center is F. The plane containing the transceiving units is defined as the x-y plane with z=0. Therefore, the position of a transceiving unit is represented by the z-coordinate and the y-coordinate relative to the center without considering the a-coordinate. For example, the position of the transceiving unit P1 is at the coordinates (−2,2), the position of the transceiving unit P2 is at the coordinates (−1,1), and the position of the transceiving unit P3 is at the coordinates (−1,−2). Similarly, the position of the transceiving unit $P_{mn}$ is at the coordinates ($x_{mn}$,$y_{mn}$).

As shown in FIG. 5, the time points when the internal transmission signals Sint_tr reach the transceiving units are not identical. In order to make the internal transmission signals Sint_tr which have passes through the transceiving module form a plane wave with consistent phase, different phase delays should be introduced according to the positions of the transceiving units located at the same plane relative to the origin O.

The distance $d_{mn}$ between the transceiving unit $P_{mn}$ and the center is calculated according to the horizontal distance $x_{mn}$ between the transceiving unit $P_{mn}$ and the y-axis and the vertical distance $y_{mn}$ between the transceiving unit $P_{mn}$ and the x-axis.

$$d_{mn}=\sqrt{x_{mn}^2+y_{nm}^2} \quad \text{(Eq. 1)}$$

Furthermore, because the feeding antenna 35, the transceiving unit $P_{mn}$ and the center O of the transceiving module determine a right triangle, the distance $f_{mn}$ between the transceiving unit $P_{mn}$ and the feeding antenna is calculated according to the distance F between the feeding antenna 35 and the center O and the distance $d_{mn}$ between the transceiving unit $P_{mn}$ and the center O.

$$f_{mn}=\sqrt{d_{mn}^2+F^2} \quad \text{(Eq. 2)}$$

The internal transmission signal Sint_tr transmitted radiately from the feeding antenna 35 passes through the transceiving unit at the center O to generate the external transmission signal. Sext_tr whose transmission direction is still parallel to the z-axis. On the other hand, the internal transmission signal Sint_tr transmitted from the feeding antenna 35 to the transceiving unit $P_{mn}$ is transmitted along a direction z1. The direction z1 is not parallel to the z-axis. In order to make the moving direction of the external transmission signal Sext_tr transmitted from the transceiving unit $P_{mn}$ be parallel to the z-axis, the controller should control the operation of the transceiving unit $P_{mn}$ to change the moving direction of the external transmission signal Sext_tr which is transmitted from the transceiving unit $P_{mn}$ from the direction z1 into a direction z1' parallel to the z-axis.

For the transceiving unit $P_{mn}$, the phase delay $\psi_{mn}$ resulting from the distance $f_{mn}$ from the feeding antenna 35 is represented by Eq. 3.

$$\Psi_{mn}=k_0 \cdot f_{mn} k_0 \sqrt{x_{mn}^2+y_{mn}^2+F^2} \quad \text{(Eq. 3)}$$

In Eq. 3, $k_0$ is wavenumber and may be calculated according to wavelength $\lambda$ of the internal transmission signal, that is, $k_0=2\pi/\lambda$. Furthermore, phase difference $\xi_{mn}$ should be adjusted for path compensation for the internal transmission signal Sint_tr transmitted from the feeding antenna 35 to the transceiving unit $P_{mn}$ relative to that to the center O may be calculated according to Eq. 4, $$\xi_{mn}=k_0 \cdot (f_{mn}-F)=k_0(\sqrt{x_{mn}^2+y_{mn}^2+F^2}-F) \quad \text{(Eq. 4)}$$

Accordingly, to enable the external transmission signals Sint_tr transmitted from the transceiving units of the transceiving module to move along the z-axis, different phase shifts introduced to the internal transmission signals Sint_tr are controlled according to the positions of the transceiving units based on Eq. 4. That is to say, the external transmission signals Sext_tr originally moving toward different directions are adjusted to be transmitted along a direction parallel to the z-axis.

In FIG. 6, it is assumed that the normal direction of the external transmission signal Sext_tr transmitted out from the transceiving module is parallel to the z-axis. Under these conditions, the transceiving unit at the center need not provide the phase shift, and the transceiving unit at the center O is considered as the reference for adjusting the phase shifts provided by other transceiving units.

Furthermore, the transceiving module can change the direction of the wavefront of the plane wave so that an angle is formed between the moving direction of the external transmission signal Sext_tr and the z-axis. In other words, the transceiving module can make beam deflection of the external transmission signal Sext_tr through phase shifters in the transceiving units.

Figure 7:
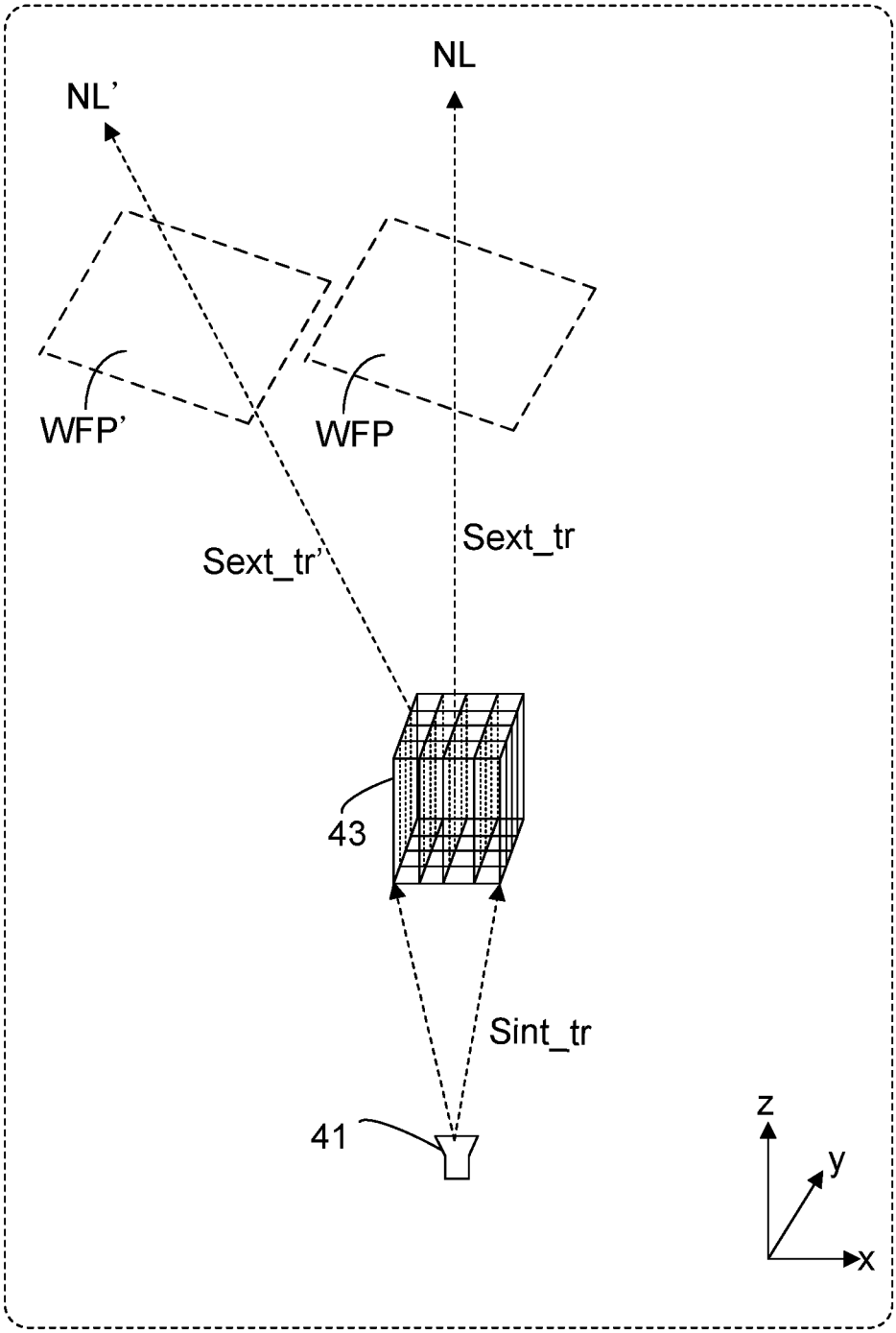
FIG. 7 is a schematic diagram illustrating that the transceiver adjusts the direction of the plane wavefront of the external transmission signals through the transceiving modules so, as to deflect the beam.

Please refer to FIG. 7, a schematic diagram illustrating that the transceiver adjusts the direction of the plane wavefront of the external transmission signal through the transceiving modules so as to deflect the beam. In this diagram, the internal transmission signals Sint_tr which are transmitted from the feeding antenna 41 to the transceiving module 43 are not adjusted. The controller only controls the operation of the transceiving module 43 to change the external transmission signal Sext_tr so as to move the plane wavefront WFP to the plane wavefront WFP'. Therefore, the transmission direction of the external transmission signal Sext_tr is changed from the original NL direction into the NL' direction moving toward the upper left.

For the application in FIG. 7, phase shift of the internal transmission signal is still required for the transceiving unit at the center O. On the other hand, for other transceiving units, in addition to the control with reference to FIG. 6, further adjustments to the setting of the phase shifters are required in response to the change of the beam direction. By the way, in the description, the beam direction, the transmission direction of the external transmission signal and the normal direction of the plane wave indicate the same direction.

Figure 8:
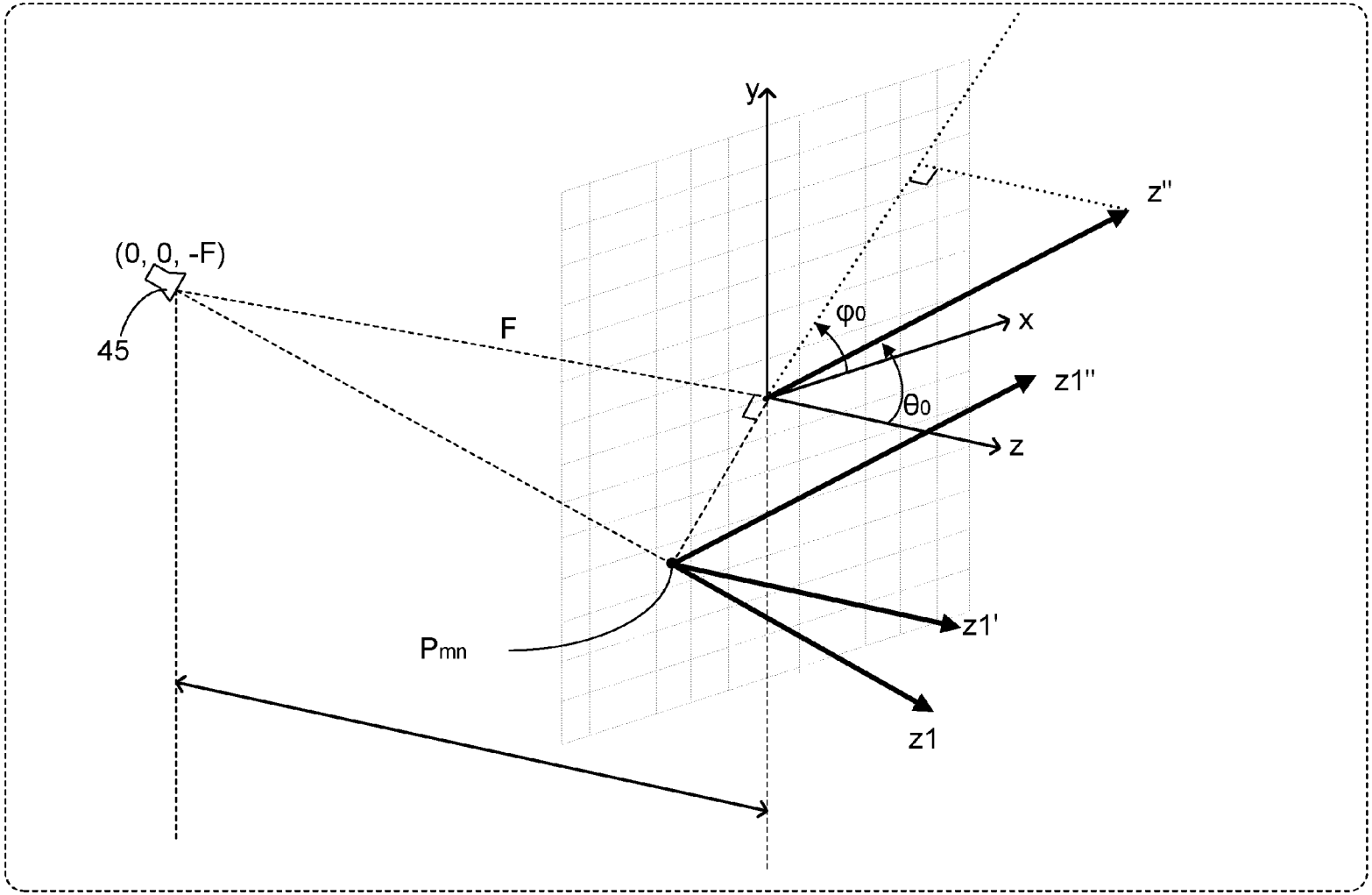
FIG. 8 is a schematic diagram illustrating that the transceiving unit at the transceiving unit plane further shifts the phase of the internal transmission signal in response to the change of the beam direction.

Please refer to FIG. 8, a schematic diagram illustrating that the transceiving unit at the transceiving unit plane further shifts the phase of the internal transmission signal in response to the change of the beam direction. In this diagram, the transmission direction of the external transmission signal Sext_tr transmitted out from the transceiving unit at the center O changes from the z-direction into the direction z". Herein, the direction z" is defined as a predetermined transmission direction of the external transmission signal Sext_tr. To keep the plane wavefront, the transmission direction of the external transmission signal Sext_tr transmitted out from the transceiving unit $P_{mn}$ does not only change from the direction z1 to the direction z1', but further changes from the direction z1' to the direction z1". That is to say, the external transmission signal Sext_tr transmitted out from the transceiving unit at the transceiving unit plane is toward the predetermined transmission direction.

In FIG. 8, the angle between the beam direction and the z-axis is defined as a reference direction angle $\theta_0$. After the beam is projected onto the x-y plane, the angle between the projected beam and the x-axis is defined as a reference elevation angle $\varphi_0$. For the transceiving unit $P_{mn}$, if it is desired to change the direction of the external transmission signal Sext_tr from the z-direction into the beam direction toward ($\theta_0$, $\varphi_0$), the phase delay $\alpha_{mn}$ adjusted for the beamforming phase term is represented by Eq. 5.

$$\alpha_{mn}=-k_0[x_{mn} \sin\theta_0 \cos\phi_0+y_{mn} \sin\theta_0 \sin\phi_0] \quad \text{(Eq. 5)}$$

The transceiving unit $P_{mn}$ performs the path compensation ($\xi_{mn}$) according to Eq. 4 and adjusts the beam phase ($\alpha_{mn}$) according to Eq. 5 for the external transmission signal Sext_tr. Therefore, as shown in Eq. 6, if the transceiving unit $P_{mn}$ wants to generate the external transmission signal Sext_tr transmitted along the direction z1", the total deflected phase $\Phi_m$ introduced to the internal transmission signal Sint_tr is the sum of Eq. 4 and Eq. 5.

$$\Phi_{mn}=\xi_{mn}+\alpha_{mn} \quad \text{(Eq. 6)}$$

In summary, the description about how the controller controls the transceiving units to adjust the phase shifts according to the positions of the transceiving units has been described with reference to FIG. 6; the description about how the controller controls the transceiving units to adjust the phase shifts according to the change of the beam direction has been described with reference to FIG. 8. Based on the description, FIG. 9 illustrates the applications in which the controller is used with a plurality of feeding antennas and transceiving modules to generate the beams with different directions.

Figure 9:
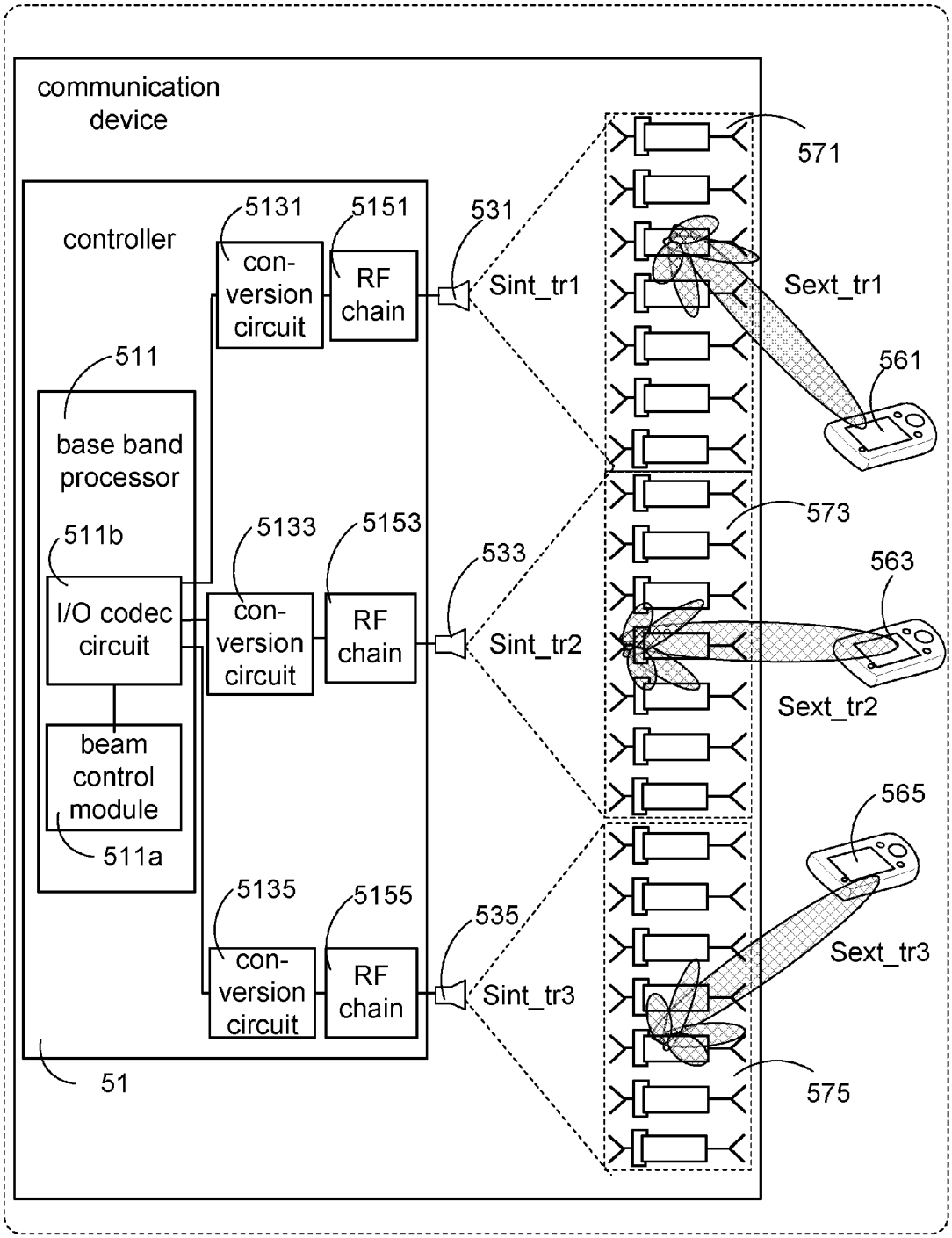
FIG. 9 is a schematic diagram illustrating that three feeding antennas transmit different internal transmission signals to three modularized transceiving modules arranged in the same row, respectively, and generate and transmit the external transmission signals to three mobile phones, respectively.

Please refer to FIG. 9, a schematic diagram illustrating that three feeding antennas transmit different internal transmission signals to three modularized transceiving modules arranged in the same row, respectively, and generate and transmit the external transmission signals to three mobile phones, respectively. In the embodiment, the communication device serves as a transmitting device to transmit the external transmission signals Sext_tr1, Sext_tr2, Sext_tr3 to the mobile phones 561, 563, 565, respectively. The communication device includes a controller 51, feeding antennas 531, 533, 535 and transceiving modules 571, 573, 575.

The controller 51 further includes a base band processor 511 and three sets of signal transmission paths. The base band processor 511 includes a beam control module 511*a* and an I/O codec circuit 511*b*. Each set of signal transmission paths includes a conversion circuit 5131, 5133, 5135 and an RF chain 5151, 5153, 5155. The conversion circuits 5131, 5133, 5135 receive the data contents in analog format from the I/O codec circuit 511*b* and convert them into data contents in digital format. Then, the RF chains 5151, 5153, 5155 transform the data contents in the digital format into the internal transmission signals. The internal transmission signals Sint_tr are RF signals including the data contents to be transmitted. Afterwards, the RF chains 5151, 5153, 5155 feed the internal transmission signals Sint_tr1, Sint_tr2, Sint_tr3 into the feeding antennas 531, 533, 535. Subsequently, the feeding antennas 531, 533, 535 radiately transmit the internal transmission signals Sint_tr1, Sint_tr2, Sint_tr3 to the transceiving modules 571, 573, 575.

Then, the transceiving modules 571, 573, 575 transform the internal transmission signals Sint_tr1, Sint_tr2, Sint_tr3 to generate the external transmission signals Sext_tr1, Sext_tr2, Sext_tr3, and radiately transmit the external transmission signals Sext_tr1, Sext_tr2, Sext_tr3 to the mobile phones 561, 563, 565. As shown in FIG. 9, when the transceiving module 571 transmits the external transmission signal Sext_tr1 to the mobile phone 561, the beam direction of the external transmission signal Sext_tr1 is toward the lower right; when the transceiving module 573 transmits the external transmission signal Sext_tr2 to the mobile phone 563, the beam direction of the external transmission signal Sext_tr2 is toward the right; when the transceiving module 575 transmits the external transmission signal Sext_tr3 to the mobile phone 565, the beam direction of the external transmission signal Sext_tr3 is toward the upper right. In other words, the controller can independently control the transceiving modules 561, 563, 565 to enable the transceiving modules 561, 563, 565 to generate the external transmission signals Sext_tr1, Sext_tr2, Sext_tr3 with different beam directions.

In FIG. 9, the communication device can provide different data contents to multiple users simultaneously. Therefore, in the embodiments according to the concepts of the present disclosure, the communication device can support multi input multi output (MIMO).

Furthermore, the direction of the beam transmitted from the transceiving module may change with time to achieve beam-steering. For the 5G communication technologies using the millimeter band, the beam width is relatively narrow so that beam-steering function is required. For example, the 3G base station can detect a mobile phone within 360° coverage, while the 5G base station can just detect a mobile phone within 120° coverage. At this time, the 5G base station should scan to and fro in order to detect the mobile phone within the entire coverage.

Figure 10:
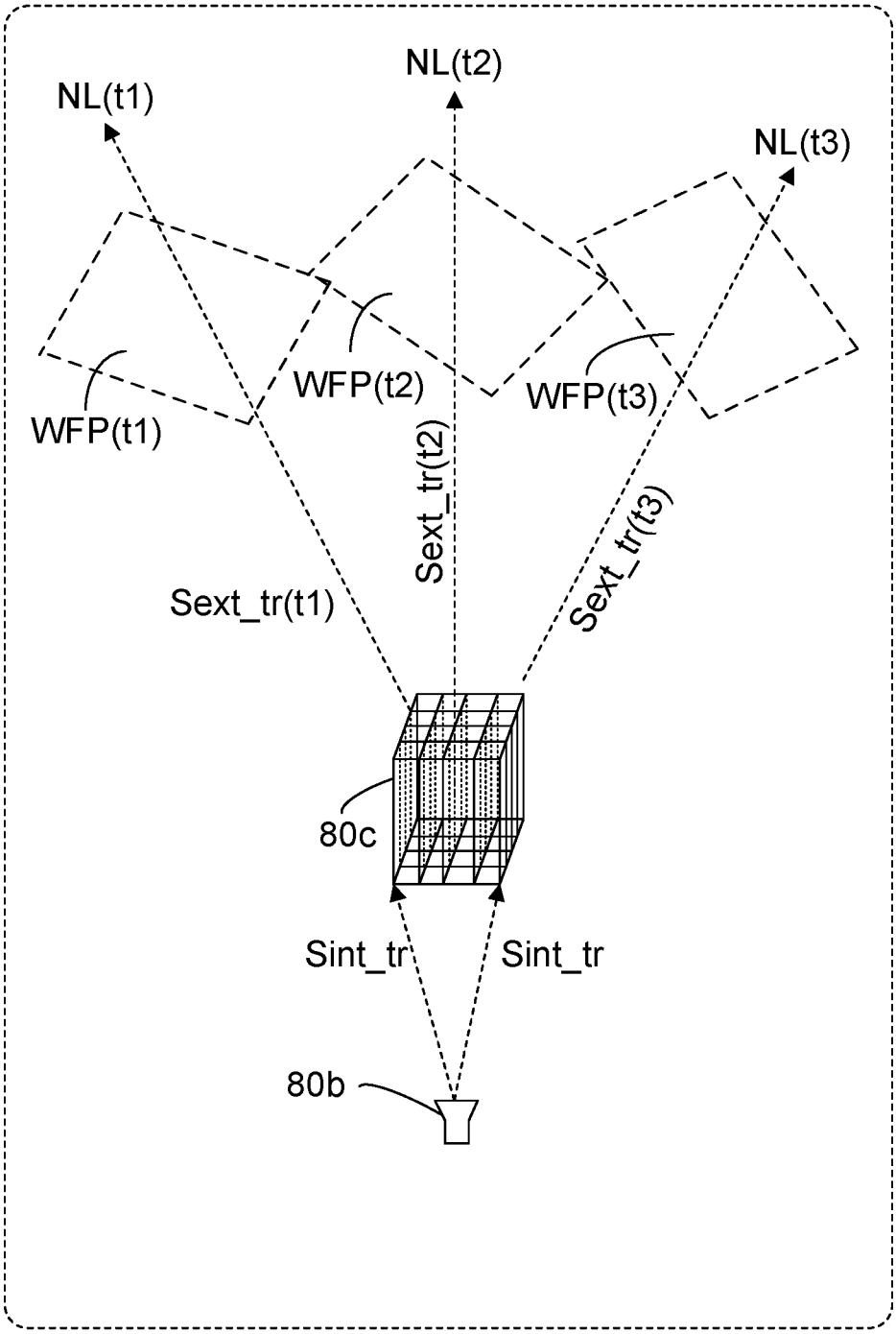
FIG. 10 is a schematic diagram illustrating that the transceiving module dynamically adjusts the direction of the plane wavefront of the external transmission signals to achieve beam-steering.

Please refer to FIG. 10, a schematic diagram illustrating that the transceiving module dynamically adjusts the direction of the plane wavefront of the external transmission signal to achieve beam-steering. Although the internal transmission signal Sint_tr transmitted from the feeding antenna 80*b* to the transceiving module 80*c* is unchanged, the controller can control the transceiving module 80*c* to enable the beam which is radiately transmitted from the transceiving module 80*c* and containing the external transmission signal Sext_tr to change with time. For example, at a time point t1, the plane wavefront WFP(t1) of the external transmission signal Sext_tr(t1) moves toward a first normal direction NL(t1); at a time point t2, the plane wavefront WFP(t2) of the external transmission signal Sext_tr(t2) moves toward a second normal direction NL(t2); at a time point t3, the plane wavefront WFP(t3) of the external transmission signal Sext_tr(t3) moves toward a third normal direction NL(t3).

Figure 11:
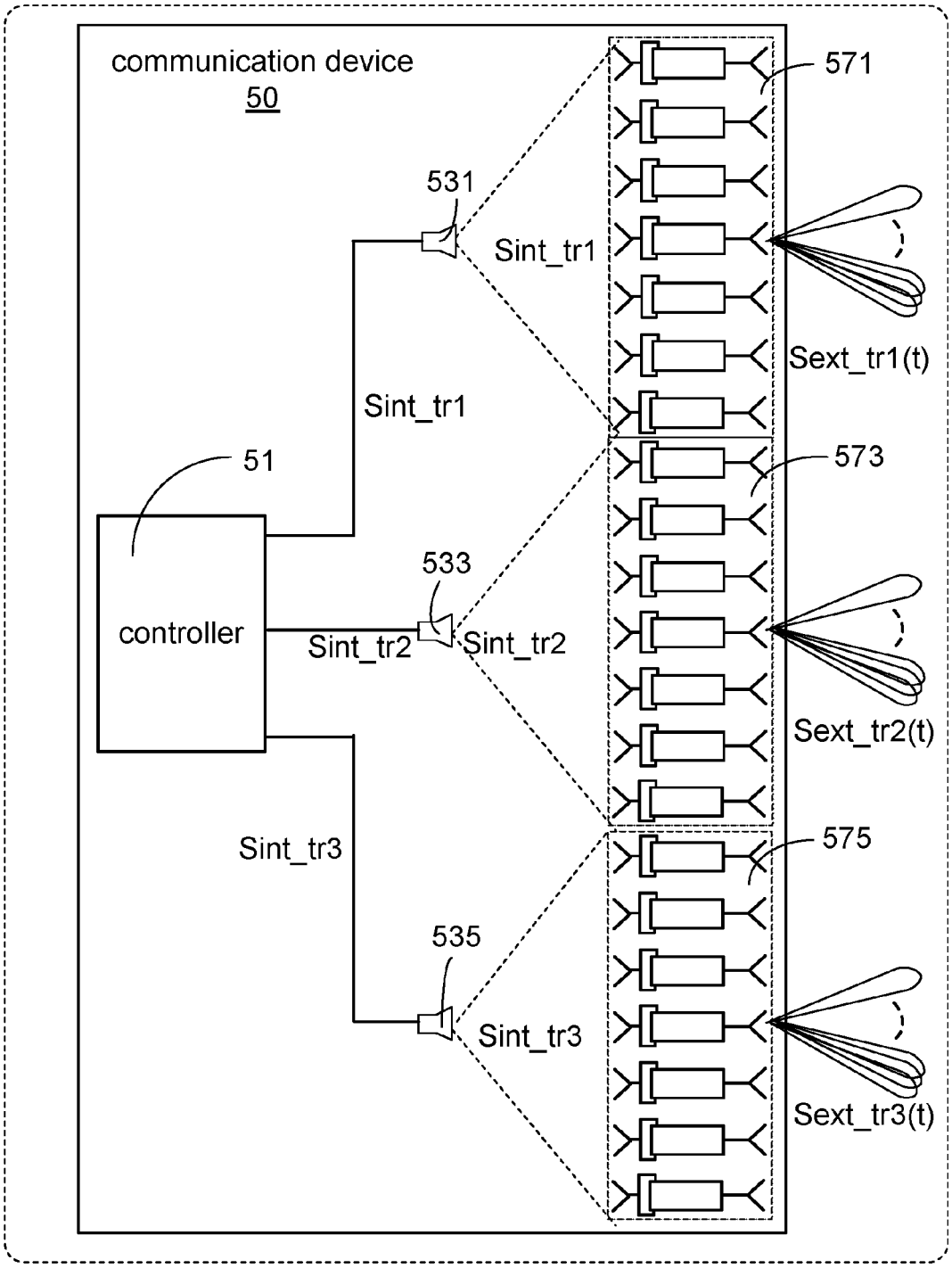
FIG. 11 is a schematic diagram illustrating that three feeding antennas transmit signals to three transceiving modules, respectively, and the three transceiving modules generate three sets of steered beams.

Please refer to FIG. 11, a schematic diagram illustrating that three feeding antennas transmit signals to three transceiving modules, respectively, and the three transceiving modules generate three sets of steered beams. In this diagram, the controller 51 generates and feeds internal transmission signals Sint_tr1, Sint_tr2, Sint_tr3 into the feeding antennas 531, 533, 535. After the feeding antennas 531, 533, 535 radiately transmit the internal transmission signals Sint_tr1, Sint_tr2, Sint_tr3 to the transceiving module 571, 573, 575 the beam directions of the external transmission signals Sext_tr1(*t*), Sext_tr2(*t*), Sext_tr3(*t*) generated by the transceiving module 571, 573, 575 can scan to and fro with time.

In the above embodiments, it is assumed that the external transmission signals generated by different transceiving modules are transmitted to different receiving devices. In the embodiments according to the concepts of the present disclosure, the transceiving module may transmit the external transmission signals to the same receiving device.

Figure 12:
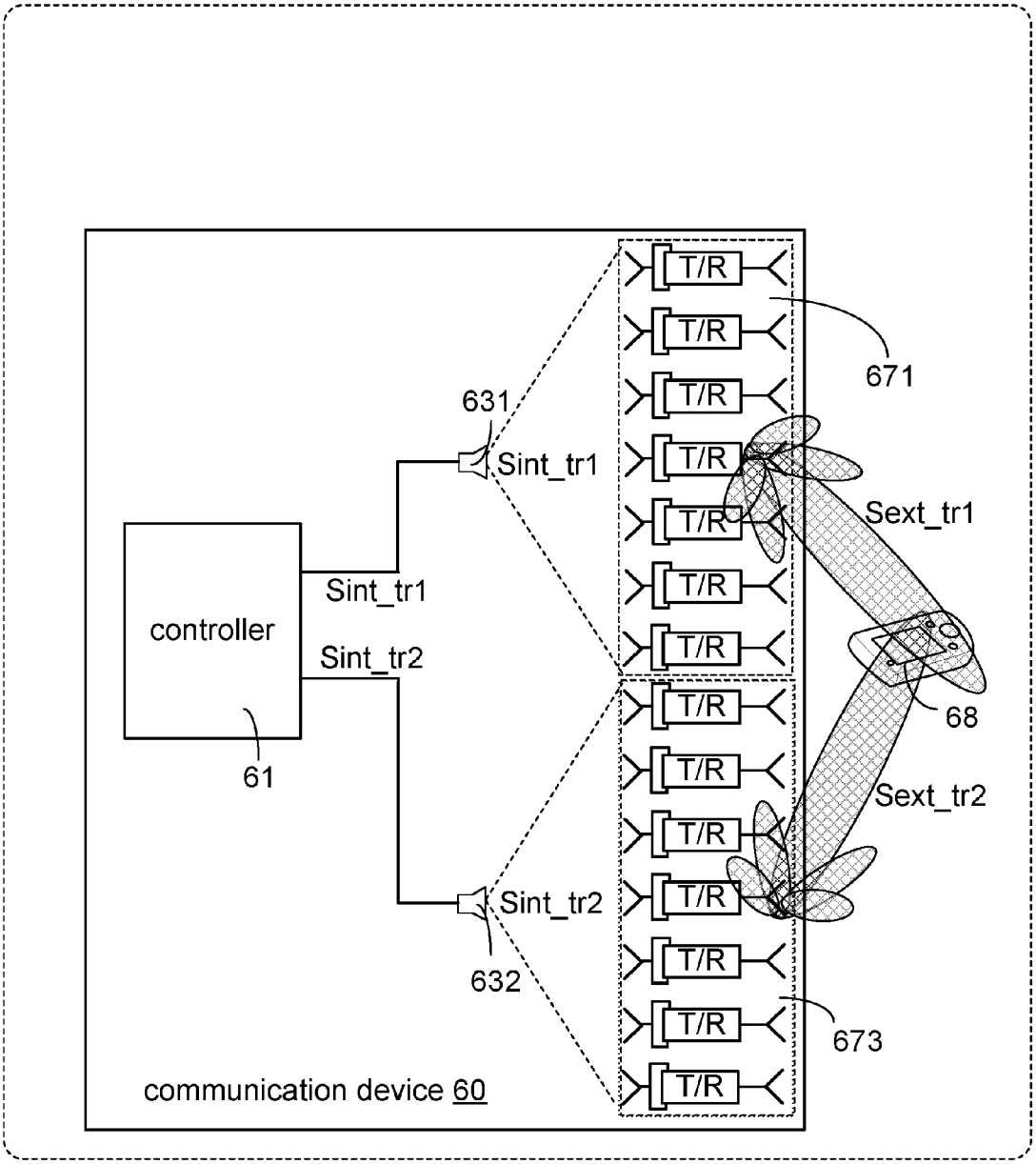
FIG. 12 is a schematic diagram illustrating that two feeding antennas transmit signals to two transceiving modules, respectively, and the two transceiving modules transmit the signals to the same mobile phone.

Please refer to FIG. 12, a schematic diagram illustrating that two feeding antennas transmit signals to two transceiving modules, respectively, and the two transceiving modules transmit the signals to the same mobile phone. In this diagram, it is assumed that the communication device simultaneously generates two sets of external transmission signals Sext_tr1, Sext_tr2 to the mobile phone 68.

The controller 61 radiately transmits the internal transmission signals Sint_tr1, Sint_tr2 to the transceiving modules 671, 673 through the feeding antennas 631, 632. After the transceiving module 671 transforms the internal transmission signal Sint_tr1 into the external transmission signal Sext_tr1, the external transmission signal Sext_tr1 is transmitted to the mobile phone 68. After the transceiving module 673 transforms the internal transmission signal Sint_tr2 into the external transmission signal Sext_tr2, the external transmission signal Sext_tr2 is transmitted to the mobile phone 68.

In FIG. 12, the internal transmission signals Sint_tr1, Sint_tr2 which are transmitted by the controller 61 through the feeding antennas 631, 632 include the data contents by using spatial diversity scheme or multiplexing scheme. For the spatial diversity scheme, the controller 61 transmits the internal transmission signals Sint_tr1, Sint_tr2 containing identical data contents through the feeding antennas 631, 632. It increases signal to noise ratio (SNR) of the mobile phone serving as the receiving device to support higher-level modulation. Otherwise, the controller 61 transmits the internal transmission signals Sint_tr1, Sint_tr2 containing different data contents through the feeding antennas 631, 632. Both schemes can increase transmission throughput of the wireless communication signals.

In the above-described embodiments, it is assumed that the transceiving modules are located side by side and aligned with a straight line. According to the concepts of the present disclosure, an included angle may be formed between the transceiving modules, and the angle ranges from 0° to 180°.

Figure 13:
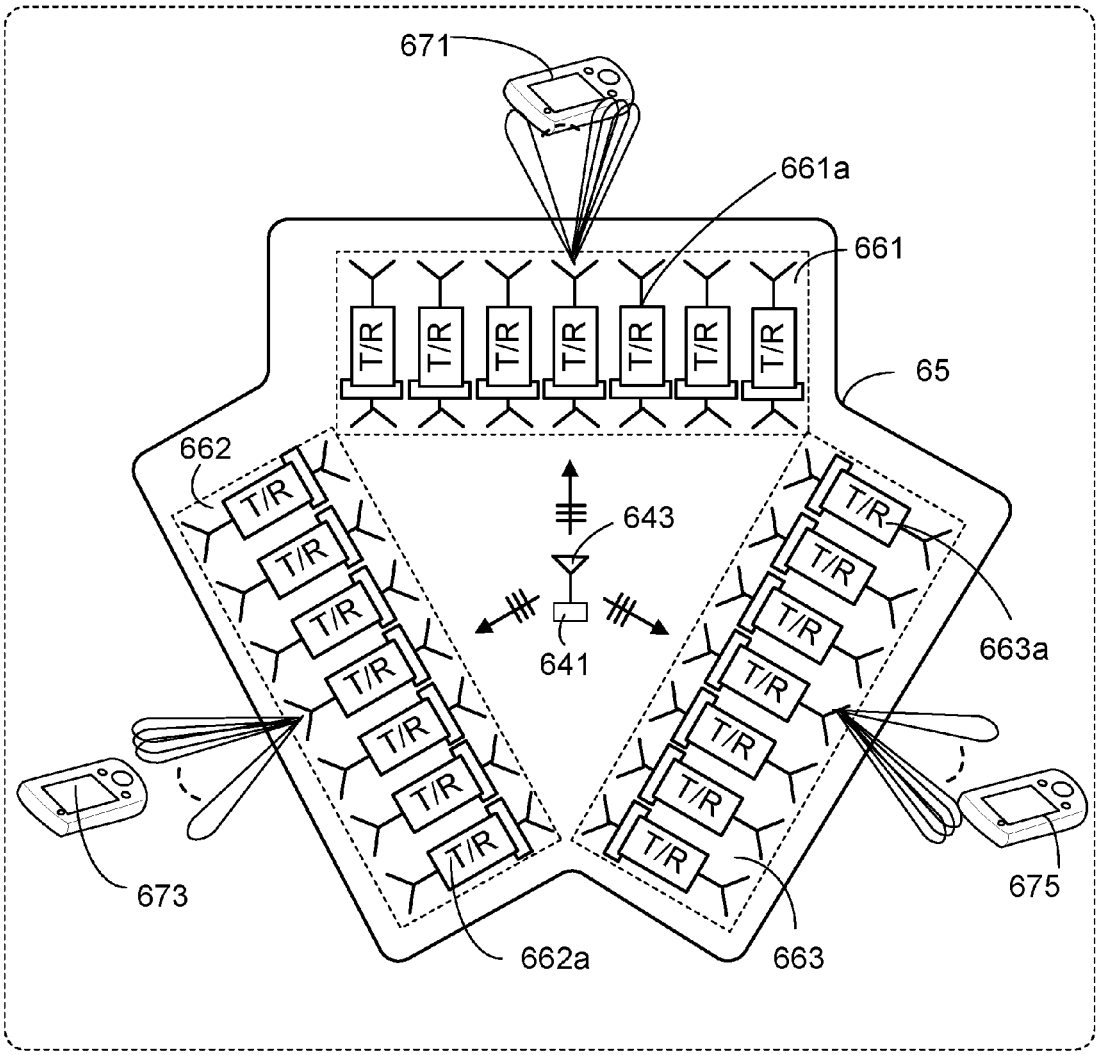
FIG. 13 is a schematic diagram illustrating that the communication device uses three transceiving modules arranged in different directions to transmit signals to or receive signals from three user devices.

Please refer to FIG. 13, a schematic diagram illustrating that the communication device uses three transceiving modules arranged in different directions to transmit signals to or receive signals from three user devices. In this embodiment, the communication device 65 serves as a transmitting device and/or a receiving device. The communication device 65 in FIG. 13 serving as the transmitting device is described with reference to FIG. 14A. The communication device 65 in FIG. 13 serving as the receiving device is described with reference to FIG. 14B.

Figure 14B:
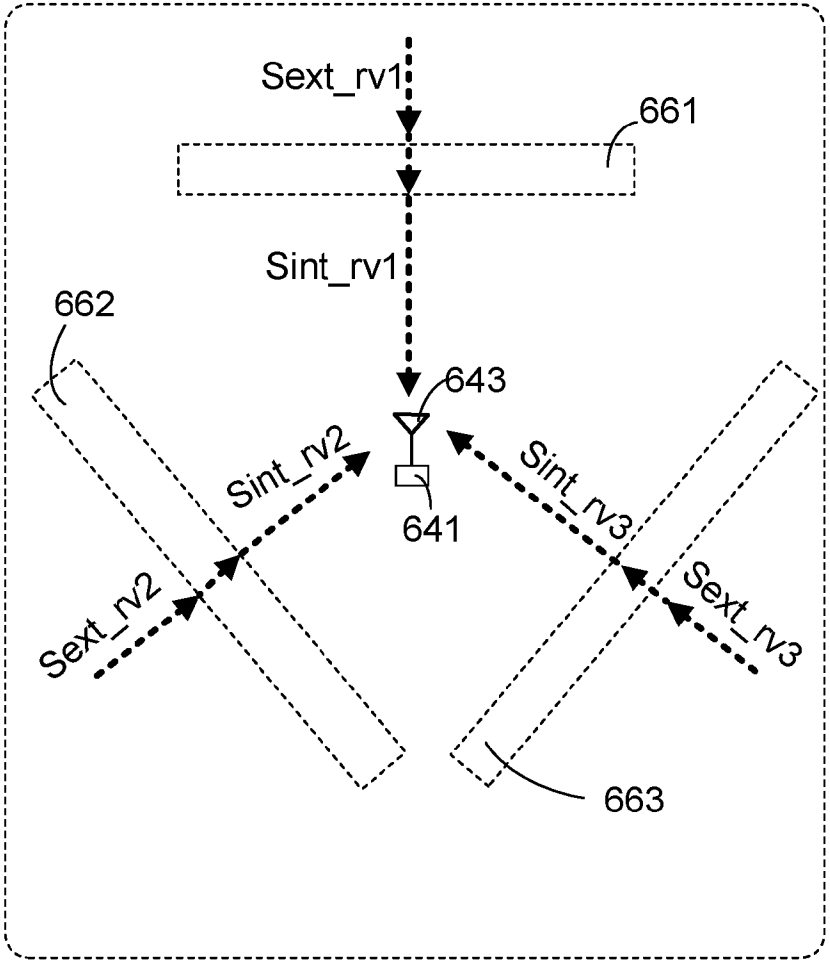
FIG. 14B is a schematic diagram illustrating the signal transmission between the feeding antenna and the transceiving modules when the communication device in FIG. 13 serves as a receiving device.
Figure 14A:
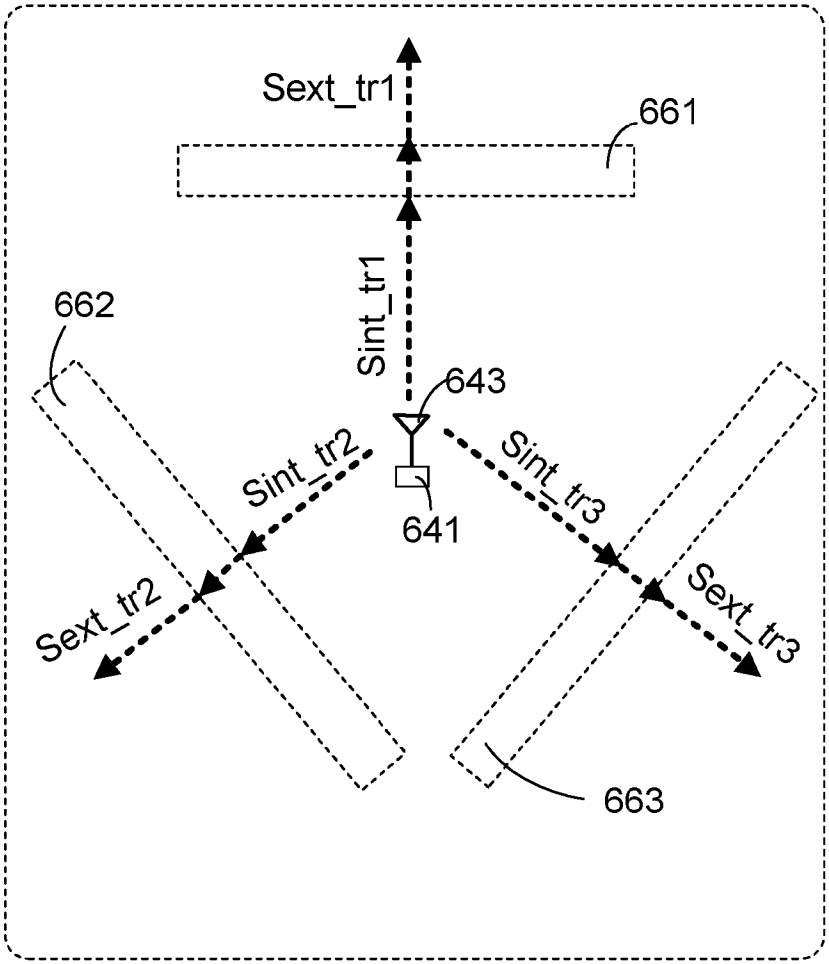
FIG. 14A is a schematic diagram illustrating the signal transmission between the feeding antenna and the transceiving modules when the communication device in FIG. 13 serves as a transmitting device.

Please refer to FIG. 14A, a schematic diagram illustrating the signal transmission between the feeding antenna and the transceiving modules when the communication device in FIG. 13 serves as a transmitting device. The controller 641 radiately transmits the internal transmission signals Sint_tr1 Sint_tr2, Sint_tr3 through the feeding antenna 643. The transceiving module 661 transforms the internal transmission signal Sint_tr1 into the external transmission signal Sext_tr1, and then transmits the external transmission signal Sext_tr1 to the mobile phone 671. The transceiving module 662 transforms the internal transmission signal Sint_tr2 into the external transmission signal Sext_tr2, and then transmits the external transmission signal Sext_tr2 to the mobile phone 673. The transceiving module 663 transforms the internal transmission signal Sint_tr3 into the external transmission signal Sext_tr3, and then transmits the external transmission signal Sext_tr3 to the mobile phone 675.

Please refer to FIG. 14B, a schematic diagram illustrating the signal transmission between the feeding antenna and the transceiving modules when the communication device in FIG. 13 serves as a receiving device. The transceiving module 661 receives the external reception signal Sext_rv1 from the mobile phone 671, and then generates the internal reception signal Sint_rv1 according to the external reception signal Sext_rv1. Afterwards, the transceiving module 661 radiately transmits the internal reception signal Sint_rv1 to the feeding antenna 643, and the controller 641 receives the internal reception signal Sint_rv1 from the feeding antenna 643. Similarly, the transceiving modules 662, 663 receive the external reception signals Sext_rv2, Sext_rv3 from the mobile phones 673, 675, respectively. Then, the transceiving module 662 generates the internal reception signal Sint_rv2 according to the external reception signal Sext_rv2; the transceiving module 663 generates the internal reception signal Sint_rv3 according to the external reception signal Sext_rv3. Afterwards, the transceiving module 662 radiately transmits the internal reception signal Sint_rv2 to the feeding antenna 643, and further to the controller 641. The transceiving module 663 radiately transmits the internal reception signal Sint_rv3 to the feeding antenna 643, and further to the controller 641.

As mentioned above, the controller can operate with various number of transceiving modules to transmit or receive the internal transmission signal or the internal reception signal through the feeding antenna. As shown in FIG. 13, in the communication device according to the concepts of the present disclosure, the positions of the transceiving modules are not limited. Furthermore, the present disclosure can decide whether to activate the transmission function and/or the reception function of the transceiving modules according to various application requirements. The following communication device is arranged as shown in FIG. 13, but it is assumed that two of the transceiving modules are disabled in transmission operation or reception operation.

Figure 15:
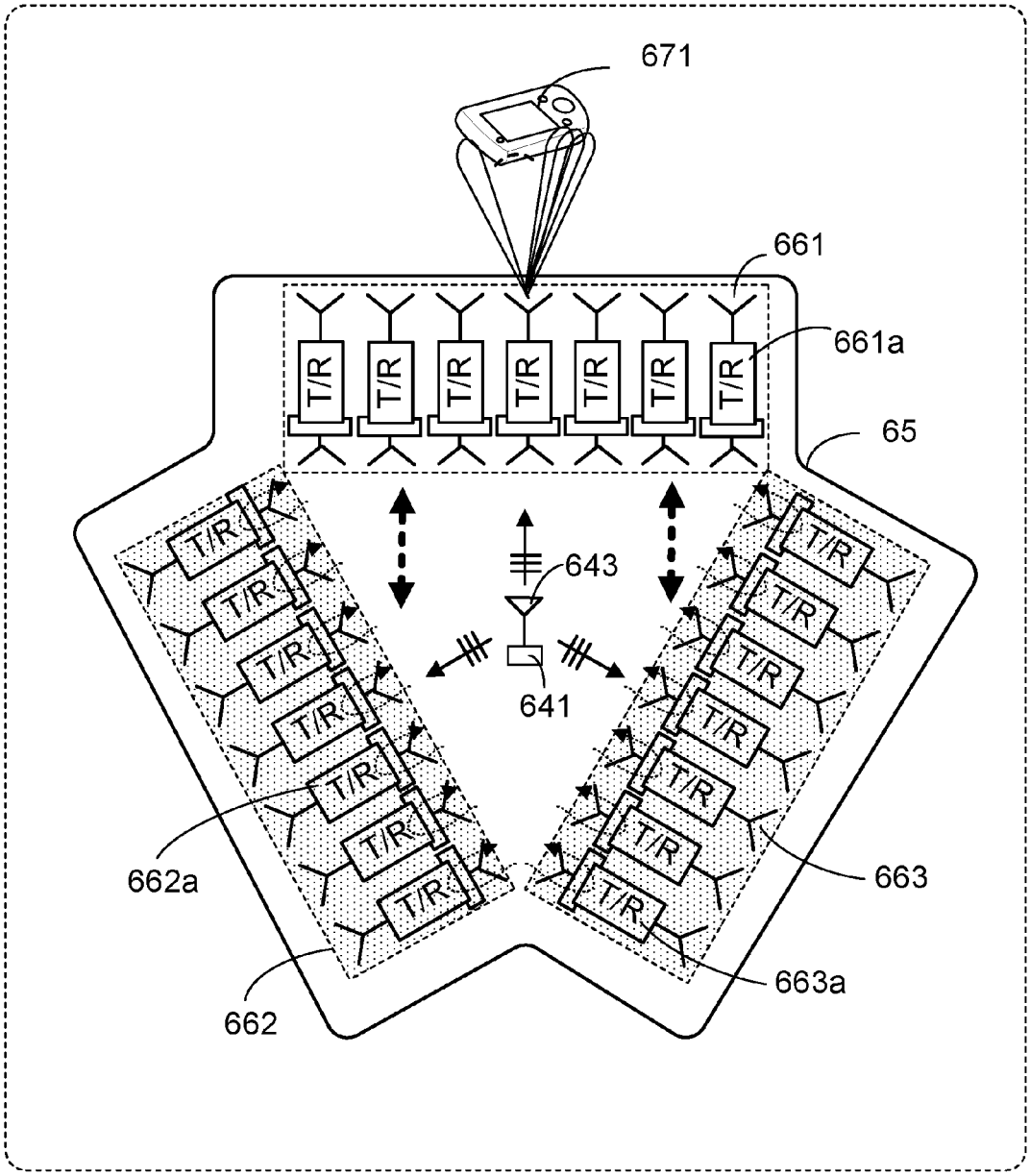
FIG. 15 is a schematic diagram illustrating that the communication device uses three transceiving modules arranged in different directions to transmit signals to or receive signals from one user device.

Please refer to FIG. 15, a schematic diagram illustrating that the communication device uses three transceiving modules arranged in different directions to transmit signals to or receive signals from one user device. The arrangement of the transceiving modules in this diagram is similar to that in FIG. 13, but it is assumed that there is only one mobile phone 671 in the communication system. Therefore, the communication device 65 does not need the transmission and reception function of the transceiving modules 662, 663, and only enables the transceiving module 661 to perform the transmission operation or reception operation.

Figure 16B:
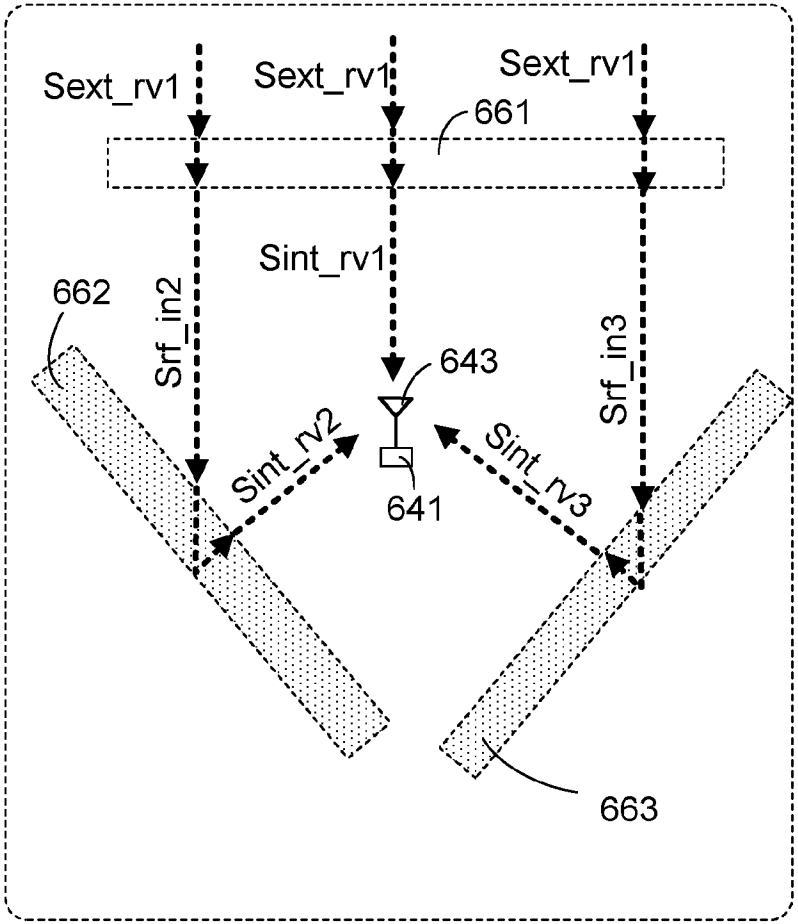
FIG. 16B is a schematic diagram illustrating the signal transmission between the feeding antenna and the transceiving modules when the communication device in FIG. 15 serves as a receiving device.
Figure 16A:
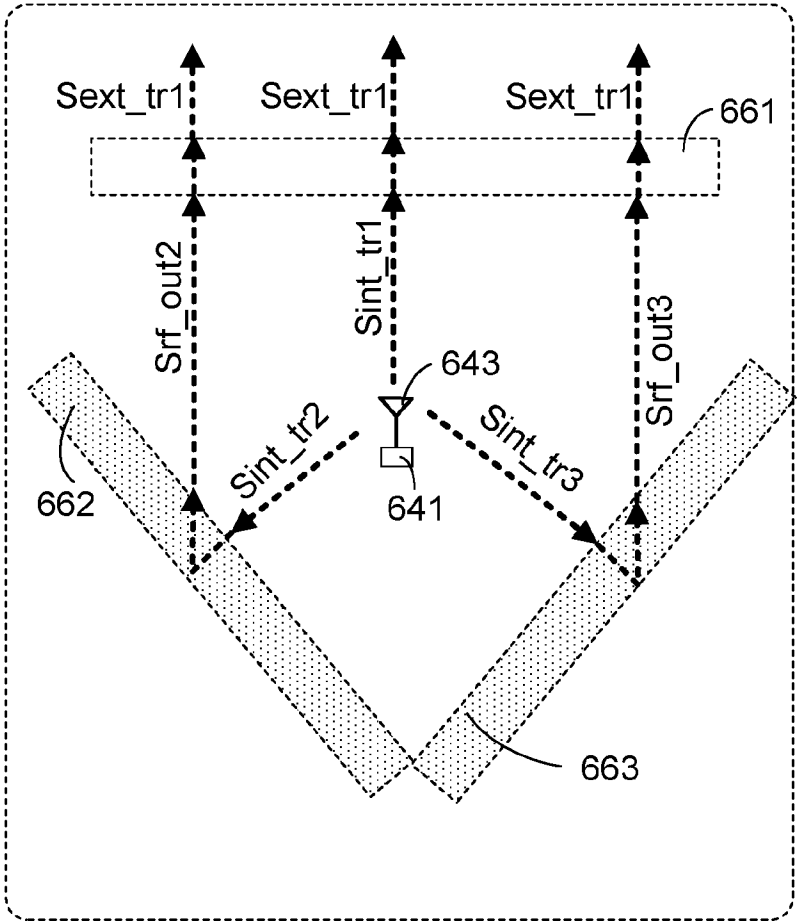
FIG. 16A is a schematic diagram illustrating the signal transmission between the feeding antenna and the transceiving modules when the communication device in FIG. 15 serves as a transmitting device.

According to the concepts of the present disclosure, the transceiving modules 662, 663 will perform reflection operation. When the transceiving modules 662, 663 perform the reflection operation, the transceiving units radiately receive reflection input signals through the end of the radiation slices near the feeding antenna, and reflect them to generate reflection output signals. The reflection output signals generated by the transceiving units are radiately transmitted from the same end of the radiation slices. In the following description, FIG. 16A illustrates that the transceiving modules 662, 663 increase the strength of the transmission signals by reflection operation when the communication device 65 transmits the signals to the mobile phone 671 through the feeding antenna 643. FIG. 16B illustrates that the transceiving modules 662, 663 increase the strength of the reception signals by reflection operation when the communication device 65 receives the signals from the mobile phone 671 through the feeding antenna 643. The description with reference to FIG. 16A and FIG. 16B describes the operation of each transceiving module as a whole, and simplified drawings are presented.

Please refer to FIG. 16A, is a schematic diagram illustrating the signal transmission between the feeding antenna and the transceiving modules when the communication device in FIG. 15 serves as a transmitting device. The controller 641 radiately transmits the internal transmission signal Sint_tr1 through the feeding antenna 643. The transceiving module 661 transforms the internal transmission signal Sint_tr1 into the external transmission signal Sext_tr1, and then transmits the external transmission signal Sext_tr1 to the mobile phone 671.

When the transceiving module 662 performs the reflection operation, the transceiving units 662*a* reflect the internal transmission signals Sint_tr2 to generate the reflection output signals Srf_out2. The reflection output signals Srf_out2 reflected and generated by the transceiving units 662*a* are transmitted toward the transceiving module 661 through the first end of the lengthwise edge of the radiation slices of the transceiving units 662*a*. Similarly, when the transceiving module 663 performs the reflection operation, the transceiving units 663*a* reflect the internal transmission signals Sint_tr3 to generate the reflection output signals Srf_out3. The reflection output signals Srf_out3 reflected and generated by the transceiving units 663*a* are transmitted toward the transceiving module 661 through the first end of the lengthwise edge of the radiation slices of the transceiving units 663*a*. Therefore, in addition to the internal transmission signal Sint_tr1 transmitted from the feeding antenna 643, the transceiving units 661*a* of the transceiving module 661 simultaneously receive the reflection output signal Srf_out2 generated by the transceiving module 662 and the reflection output signal Srf_out3 generated by the transceiving module 663.

It should be noted that the feeding antenna can transmit the internal transmission signals Sint_tr2, Sint_tr3 which are identical to the internal transmission signal Sint_tr1 because the reflection output signals Srf_out2, Srf_tr3 come from the internal transmission signals Sint_tr2, Sint_tr3 emitted out from the antenna 643. In other words, in addition to the original internal transmission signal Sint_tr received from the antenna 643, the transceiving module 661 further indirectly receives the reflected internal transmission signals Srf_tr2, Srf_tr3 from the transceiving modules 662, 663. Concerning the transceiving module 661, the transceiving units 661*a* actually receive signals from three sources, the signals from the three sources are the same. Therefore, it represents that the transceiving module 661 receives the internal transmission signal with increased strength. By the way, the external transmission signal Sext_tr1 generated by the transceiving module 661 has increased strength.

Please refer to FIG. 16B, a schematic diagram illustrating the signal transmission between the feeding antenna and the transceiving modules when the communication device in FIG. 15 serves as a receiving device. The transceiving module 661 receives the external reception signal Sext_rv1 from the mobile phone 671, and then generates the internal reception signal Sint_rv1 according to the external reception signal Sext_rv1. Afterwards, the transceiving module 661 radiately transmits the internal reception signal Sint_rv1 to the feeding antenna 643, and the controller 641 receives the internal reception signal Sint_rv1 through the feeding antenna 643.

When the transceiving module 662 performs the reflection operation, the transceiving units 662*a* receive the reflection input signals Srf_in2 from the transceiving module 661. The reflection input signals Srf_in2 are equivalent to the internal reception signal Sint_rv1 generated by transforming the external reception signal Sext_rv1 with the transceiving module 661. The transceiving units 662*a* reflect the reflection input signals Srf_in2 and generate the internal reception signals Sint_rv2. Then, the transceiving units 662*a* radiately transmit the internal reception signals Sint_rv2 to the feeding antenna 643. Similarly, when the transceiving module 663 performs the reflection operation, the transceiving units 663*a* receive the reflection input signals Srf_in3 from the transceiving module 661. The reflection input signals. Srf_in3 are equivalent to the internal reception signals Sint_rv1 generated by transforming the external reception signal Sext_rv1 with the transceiving module 661. The transceiving units 663*a* reflect the reflection input signals Srf_in3 and generate the internal reception signals Sint_rv3. Then, the transceiving units 663*a* radiately transmit the internal reception signals Sint_rv3 to the feeding antenna 643.

Therefore, the feeding antenna 643 directly receives the internal reception signal Sint_rv1 from the transceiving module 661, and simultaneously receives the reflection output signal (that is, the internal reception signal Sint_rv2) from the transceiving module 662 and the reflection output signal (that is, the internal reception signal Sint_rv3) from the transceiving module 663.

It should be noted that the internal reception signals Sint_rv2, Sint_rv3 come from the reflection input signals Srf_in2, Srf_in3 generated by transforming the external reception signal Sext_rv1. The feeding antenna 643 actually receives the internal reception signals from three sources, and the internal reception signals from the three sources are the same. Therefore, it represents that the feeding antenna 643 receives the internal transmission signal with increased strength.

Figure 17:
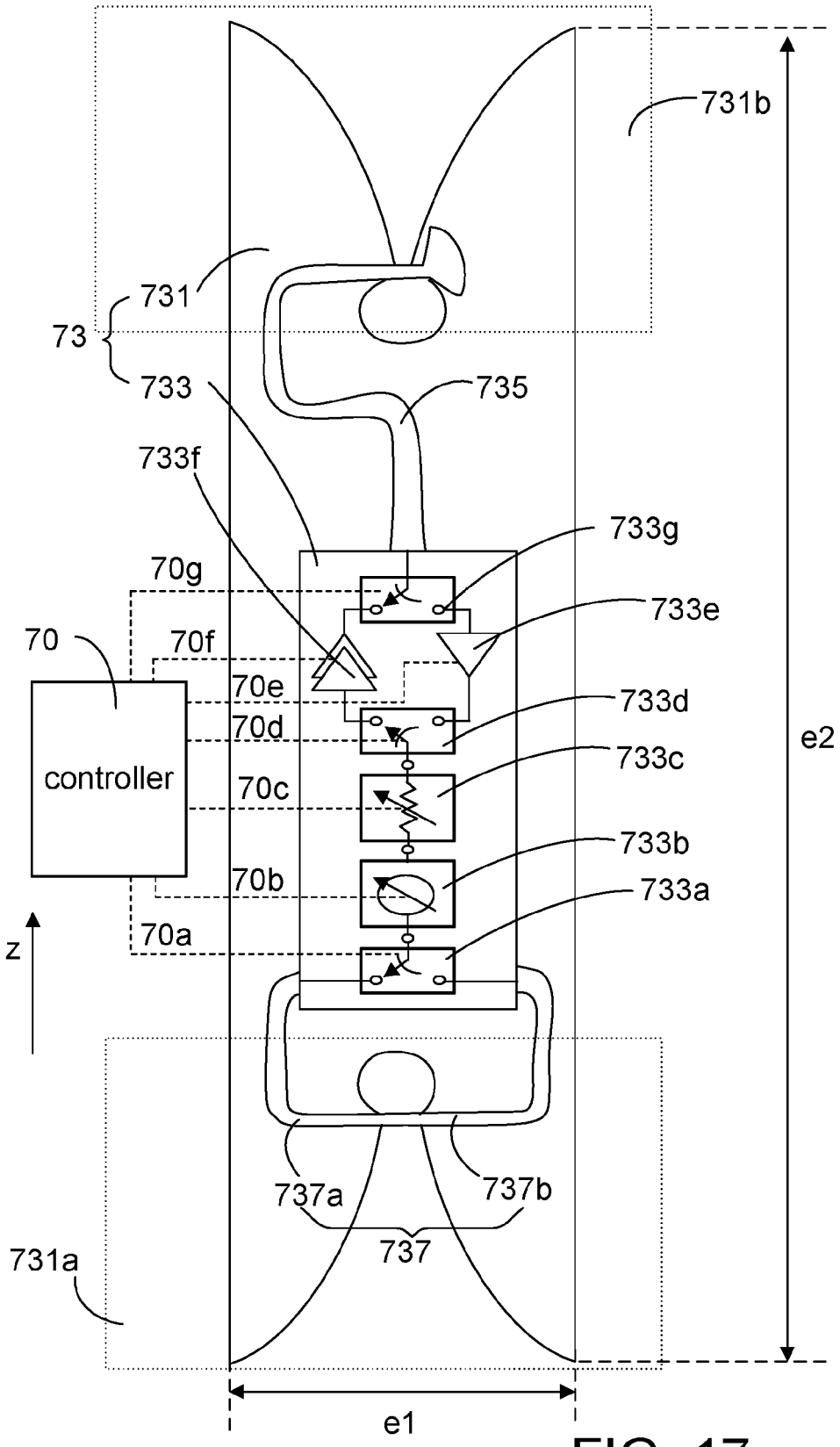
FIG. 17 is a schematic diagram illustrating a transceiving unit.

Then, FIG. 17 illustrates a transceiving unit according to the concepts of the present disclosure. It should be noted that the design of the transceiving unit of the present disclosure is relatively flexible. It does not limit the appearance of the radiation slice and the internal units in the transceiving circuit in the following examples.

Please refer to FIG. 17, a schematic diagram illustrating a transceiving unit. As shown in FIG. 17, each transceiving unit 73 of the transceiving module includes an approximately rectangular radiation slice 731 and a transceiving circuit 733 disposed on the radiation slice 731. The radiation slice 73 is made of a conductive material and has a lengthwise edge e2 and a widthwise edge e1 perpendicular to each other. Two ends of the lengthwise edge e2 are toward the inner lateral side and the outer lateral side of the transceiving module, respectively, and the widthwise edge e1 is parallel to the inner lateral side and the outer lateral side.

Herein, the end (at bottom in FIG. 17) of the lengthwise edge e2 of the radiation slice 731 toward the feeding antenna is defined as a first end 731*a*, and the other end (at top in FIG. 17) of the radiation slice 731 toward the outside of the communication device is defined as a second end 731*b*. Tapered slot antenna structure with wideband property is formed at both ends of the lengthwise edge e2 of the radiation slice 731. The operating frequency ranges from 26 GHz to 42 GHz.

The transceiving circuit 733 includes an internal feeding path 737, an external feeding path 735, a phase switch circuit 733*a*, a phase shifter 733*b*, an attenuator 733*c*, functional switch circuits 733*d*, 733*g*, a transmitting amplifier 733*f* and a low noise amplifier 733*e*. In FIG. 17, the controller 70 issues control signals 70*a*-70*g* to the transceiving circuit 733.

The internal feeding path 737 further includes a first phase feeding path 737*a* and a second phase feeding path 737*b*. The first phase feeding path 737*a* and the second phase feeding path 737*b* receive the internal transmission signals from the first end of the lengthwise edge of the radiation slice 731 simultaneously. Since the first phase feeding path 737*a* and the second, phase feeding path 737*b* have opposite feeding directions, the physical characteristics results in a phase difference of 180° between the internal transmission signals passing through the first phase feeding path 737*a* and the second phase feeding path 737*b*.

The feeding paths designed based on physical structure are suitable for wideband application. Compared to the common phase shifter, the physical characteristics due to the phase difference of 180° between the first phase feeding path 737*a* and the second phase feeding path 737*b* does not vary with the frequency. Therefore, such method for generating opposite signals by specific structure can reduce the design complexity and consumption of the phase shifter 733*b*. Therefore, the phase shifter 733*b* may introduce a phase delay to the transmission signal and/or reception signal by slightly adjusting one of the signals with a smaller difference. For example, if a phase delay of 30° is required, the signal from the first phase feeding path 737*a* is selected, and the phase shifter 733*b* provides a phase delay of 30°. If a phase delay of 210° is required, the signal from the second phase feeding path 737*b* is selected, and the phase shifter 733*b* also provides a phase delay of 30°. Such structure can significantly reduce consumption of the phase shifter 733*b* and reduce phase-shifting error.

The phase switch circuit 733*a* further includes two selector switches. One end of one selector switch is electrically connected to the phase shifter 733*b*, and the other end is electrically connected to the first phase feeding path 737*a*; one end of the other selector switch is electrically connected to the phase shifter 733*b*, and the other end is electrically connected to the second phase feeding path 737*b*.

By switching among the selector switches of the phase switch circuit 733*a*, the phase shifter 733*b* can select the signal from one of the phase feeding paths. Otherwise, if two selector switches of the phase switch circuit 733*a* are switched off, the transceiving unit 73 performs the reflection operation. At this time, the phase shifter 733*b* does not affect the reflection signals.

Furthermore, the attenuator 733*c* is used with the transmitting amplifier 733*f* and the low noise amplifier 733*e* to adjust the gains of the transmitting amplifier 733*f* and the low noise amplifier 733*e* so as to compensate the consumption due to defective pattern of the feeding antenna and inhibit the side lobes. The phase shifter 733*b* is used for phase control to compensate the phase difference due to path difference illustrated in FIG. 6 and Eq. 4 and adjust the phase for beamforming illustrated in FIG. 8 and Eq. 5.

The functional switch circuit 733*d* further includes two selector switches. One selector switch is electrically connected between the attenuator 733*c* and the transmitting amplifier 733*f*. The other selector switch is electrically connected between the attenuator 733*c* and the low noise amplifier 733*e*. The functional switch circuit 733*g* further includes two selector switches. One selector switch is electrically connected between the transmitting amplifier 733*f* and the external feeding path 735. The other selector switch is electrically connected between the low noise amplifier 733*e* and the external feeding path 735.

The selector switches of the functional switch circuits 733*d*, 733*g* are disposed in pairs. When the transceiving circuit 733 is configured to transmit the external transmission signal Sext_tr, both selector switches connected to the transmitting amplifier 733*f* are switched on, and both selector switches connected to the low noise amplifier 733*e* are switched off. On the contrary, when the transceiving circuit 733 is configured to receive the external reception signal Sext_rv, both selector switches connected to the low noise amplifier 733*e* are switched on, and both selector switches connected to the transmitting amplifier 733*f* are switched off. Furthermore, when the transceiving circuit 733 is configured to perform the reflection operation, both selector switches of the functional switch circuits are switched off.

In FIG. 17, if the gains of the transmitting amplifier 733*f* and the low noise amplifier 733*e* are adjusted quantitatively, the attenuator 733*c* is required. In practice, the transceiving circuit may include a transmitting amplifier and a low noise amplifier with flexibly adjustable gains. Thus, additional attenuator is not required for such transceiving circuit with flexibly adjustable gains.

According to the concepts of the present disclosure, the transceiving circuit 733 may support the transmission operation, reception operation and two types of reflection operation. The transceiving circuit in FIG. 18 performs the transmission operation; the transceiving circuit in FIG. 19 performs the reception operation; the transceiving circuits in FIG. 20A and FIG. 20B perform the reflection operation. When the transceiving circuit 733 performs the transmission operation or the reception operation, radiate transmission and radiate reception are performed at two ends of the lengthwise edge e2 of the radiation slice 731, respectively. In addition, the transceiving circuit 733 is used with the radiation slice 731 to perform the reflection operation on the reflection input signal to generate the reflection output signal. When the transceiving circuit 733 performs the reflection operation on the reflection input signal, the radiate reception and radiate transmission are performed only at the first end of the lengthwise edge e2 of the radiation slice 731.

Figure 18:
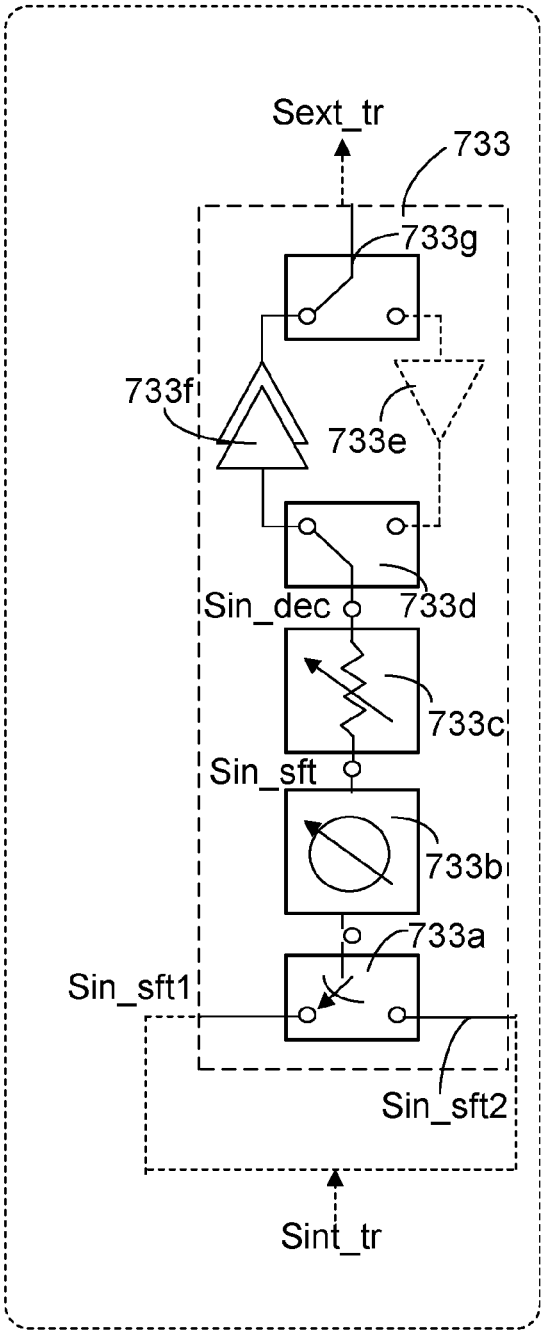
FIG. 18 is a schematic diagram illustrating that the transceiving circuit performs the transmission operation.

Please refer to FIG. 18, a schematic diagram illustrating that the transceiving circuit performs the transmission operation. The first phase feeding path 737*a* receives the internal transmission signal Sint_tr through the first end of the lengthwise edge e2 of the radiation slice 731, and then generates a first phase input signal Sin_sft1. The second phase feeding path 737*b* receives the internal transmission signal Sint_tr through the first end 731*a* of the lengthwise edge, and then generates a second phase input signal Sin_sft2. As described with reference to FIG. 17, the first phase input signal Sin_sft1 and the second phase input signal Sin_sft2 are opposite signals.

One end of the phase switch circuit 733*a* is electrically connected to one of the first phase feeding path 737*a* and the second phase feeding path 737*b*. The other end of the phase switch circuit 733*a* is electrically connected to the phase shifter 733*b*. The phase shifter 733*b* receives the first phase input signal Sin_sft1 or the second phase input signal Sin_sft2 through the phase switch circuit, then a phase delay is introduced to generate a shifted input signal Sin_sft. The attenuator 733*c* adjusts the strength of the shifted input signal Sin_sft to generate an attenuated input signal Sin_dec.

When the transceiving circuit 733 is used for transmission, the functional switch circuit 733*d* conducts connection between the attenuator 733*c* and the transmitting amplifier 733*f*, and the functional switch circuit 733*g* conducts connection between the transmitting amplifier 733*f* and the external feeding path 735. The attenuated input signal Sin_dec generated by the attenuator 733*c* is transmitted to the transmitting amplifier 733*f* through the functional switch circuit 733*d*. Then, the transmitting amplifier 733*f* adjusts the strength of the attenuated input signal Sin_dec to generate the external transmission signal Sext_tr. The functional switch circuit 733*g* transmits the external transmission signal Sext_tr generated by the transmitting amplifier 733*f* to the external feeding path 735. The external feeding path 735 feeds the external transmission signal Sext_tr to the second end 731*b* of the lengthwise edge e2 of the radiation slice 731.

Figure 19:
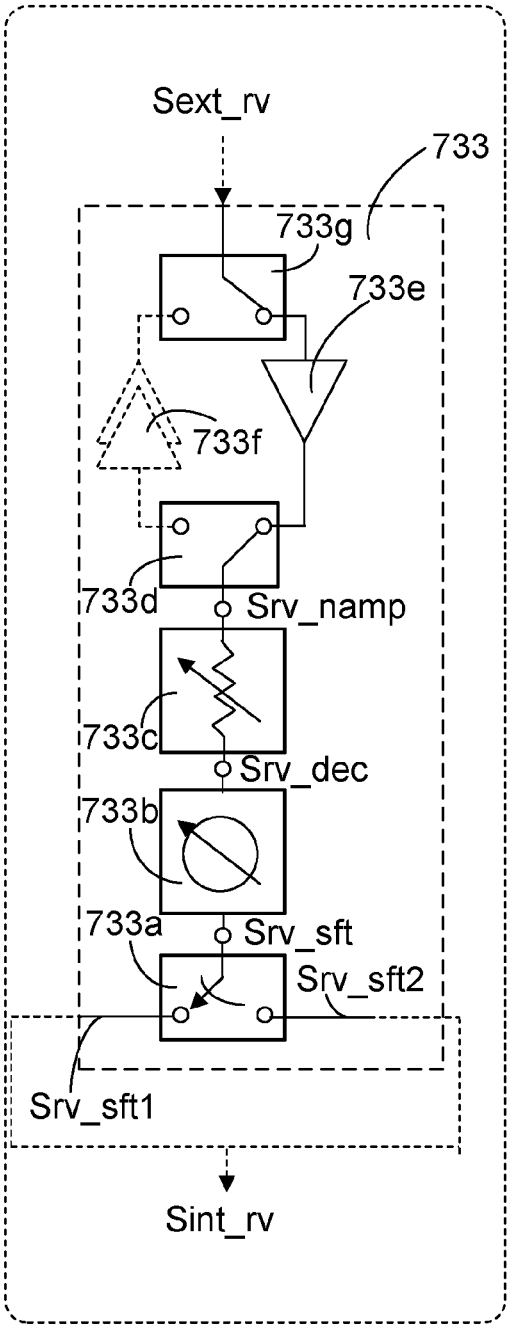
FIG. 19 is a schematic diagram illustrating that the transceiving circuit performs the reception operation.

Please refer to FIG. 19, a schematic diagram illustrating that the transceiving circuit performs the reception operation. When the transceiving circuit 733 is used for reception, the external feeding path 735 receives the external reception signal Sext_rv through the second end 731*b* of the lengthwise edge e2 of the radiation slice 731. After the functional switch circuit 733*g* conducts the external reception signal Sext_rv to the low noise amplifier 733*e*, the low noise amplifier 733*e* generates a low noise reception signal Srv_namp.

At this time, the functional switch circuit 733*d* conducts connection between the attenuator 733*c* and the low noise amplifier 733*e*. Therefore, the attenuator 733*c* receives the low noise reception signal Srv_namp and adjusts the strength of the low noise reception signal Srv_namp to generate an attenuated reception signal Srv_dec. The phase shifter 733*b* introduces the phase shift to the attenuated reception signal Srv_dec to generate a shifted reception signal Srv_sft. The first phase feeding path 737*a* receives the shifted reception signal Srv_sft through the phase switch circuit 733*a*, and generates a first phase reception signal Srv_sft1 and feeds the first phase reception signal Srv_sft1 into the first end 731*a* of the lengthwise edge. The second phase feeding path 737*b* receives the shifted reception signal Srv_sft through the phase switch circuit 733*a*, and generates a second phase reception signal Srv_sft2 and feeds the second phase reception signal Srv_sft2 into the first end 731*a* of the lengthwise edge. The phase switch circuit 733*a* conducts connection between the phase shifter 733*b* and one of the first phase feeding path 737*a* and the second phase feeding path 737*b*. As described with reference to FIG. 17, the first phase reception signal Srv_sft1 and the second phase reception signal Srv_sft2 are opposite signals.

Two types of reflection operation performed by the transceiving unit are given here. Concerning the first type of reflection operation in FIG. 20A and FIG. 20B, the transceiving unit 73 uses the phase switch circuit 733*a* to generate the reflection signal. Concerning the second type of reflection operation in FIG. 21A and FIG. 21B, the transceiving unit 73 uses the functional switch circuit 733*d* to generate the reflection signal.

Figure 20A:
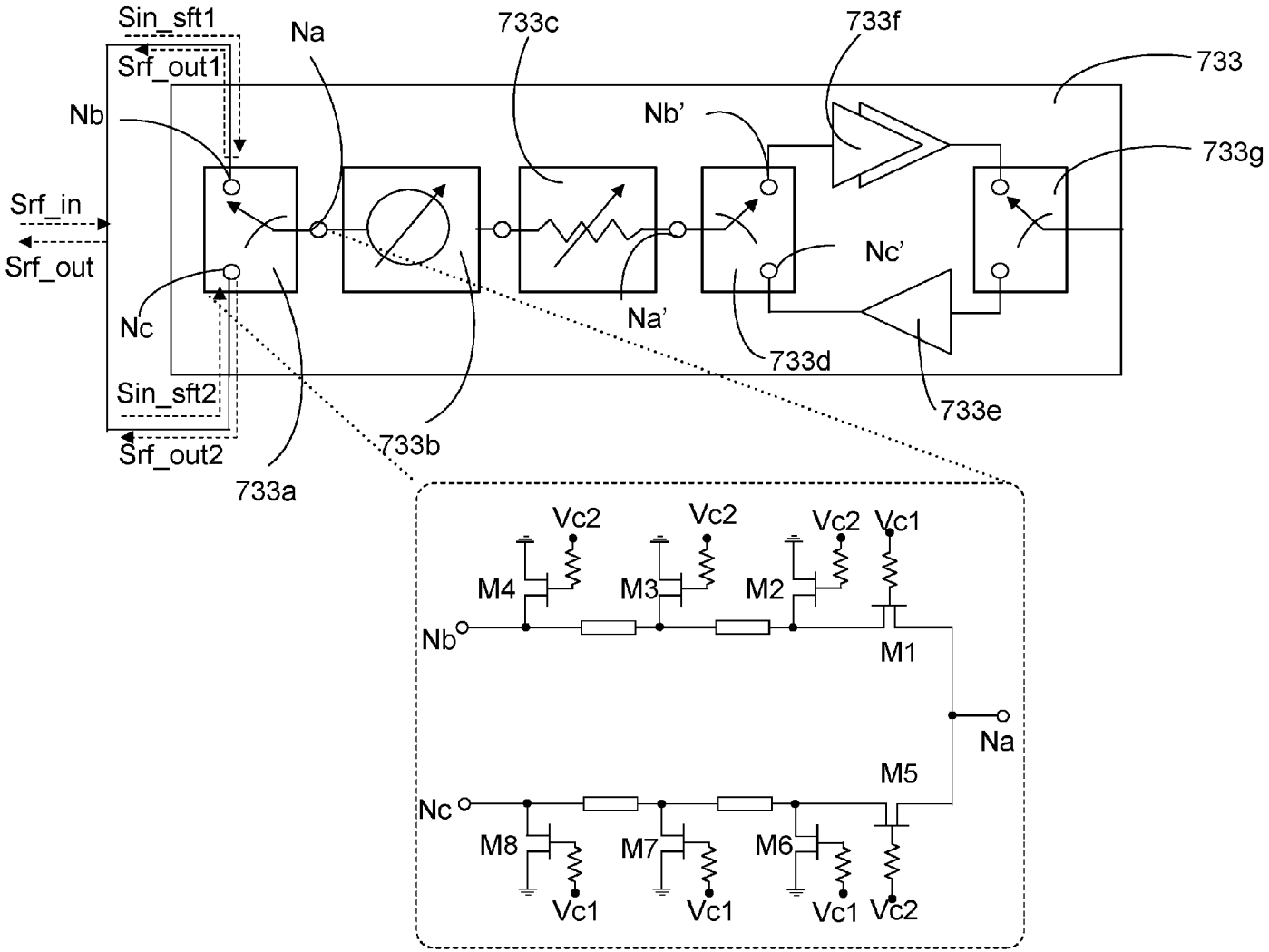
FIG. 20A is a schematic diagram illustrating that the transceiving circuit performs the first type of reflection operation.

Please refer to FIG. 20A, a schematic diagram illustrating that the transceiving circuit performs the first type of reflection operation. The phase switch circuit 733*a* is connected to the phase shifter 733*b*, the first phase feeding path 737*a* and the second phase feeding path 737*b* through the nodes Na, Nb and Nc. An enlarged drawing of the phase switch circuit 733*a* is shown at the bottom of FIG. 20A. Transistors M1~M4 are provided between the nodes Na and Nb at the upper path; transistors M5~M8 are provided between the nodes Na and Nc at the lower path. The transistors M1 and M6~M8 are controlled by a first switch control signal (Vc1), and the transistors M2~M5 are controlled by a second switch control signal (Vc2).

The phase switch circuit 733*a* mainly includes a first selector switch (e.g. the transistor M1) and a second selector switch (e.g. the transistor M5). The transistors M1, M5 are switching transistors of the phase switch circuit. The phase switch circuit 733*a* further includes a plurality of auxiliary switches (e.g. the transistors M2~M4, M6~M8). The transistors M2~M4, M6~M8 are used for enhancing signal transmission quality. When the first switch control signal (Vc1) is at a high level, the transistors M1, M6~M8 are switched on, and vice versa. When the second switch control signal (Vc2) is at a high level, the transistors M2~M5 are switched off, and vice versa.

One end of the transistor M1 is electrically connected to the phase shifter 733*b* through the node Na, and the other end is electrically connected to the first phase feeding path 737*a* through the node Nb. The transistor M1 selectively conducts the connection between the phase shifter 733*b* and the first phase feeding path 737*a* according to the level of the first switch control signal (Vc1). One end of the transistor M5 is electrically connected to the phase shifter 733*b* through the node Na, and the other end is electrically connected to the second phase feeding path 737*b* through the node Nc. The transistor M5 selectively conducts the connection between the phase shifter 733*b* and the second phase feeding path 737*b* according to the level of the second switch control signal (Vc2). Table 1 shows that the transistors M1~M8 of the phase switch circuit 733*a* control the connection states between different nodes in response to different operation modes of the transceiving unit 73.

TABLE 1

| Connection | Transistor | | | | | | | |
|---|---|---|---|---|---|---|---|---|
| between nodes | M1 | M2 | M3 | M4 | M5 | M6 | M7 | M8 |
| Na, Nb | ON | OFF | OFF | OFF | OFF | ON | ON | ON |
| Na, Nc | OFF | ON | ON | ON | ON | OFF | OFF | OFF |
| No connection | OFF | ON | ON | ON | OFF | ON | ON | ON |

Please refer both the enlarged drawing of the phase switch circuit at the bottom of FIG. 20A and table 1. The phase switch circuit 733*a* may support three modes. The first row of table 1 indicates a first mode which conducts the connection between the nodes Na and Nb so that the signals are transmitted between the first phase feeding path 737*a* and the phase shifter. The second row of table 1 indicates a second mode which conducts the connection between the nodes Na and Nc so that the signals are transmitted between the second phase feeding path 737*b* and the phase shifter. The third row of table 1 indicates a third mode wherein no connection is conducted between the nodes, and the transceiving unit 73 performs the reflection operation. The first row and the second row of table 1 correspond to the transmission operation or the reception operation of the transceiving unit 73.

In the first mode, the phase switch circuit 733*a* selects and conducts the upper path, and the transistor M1 connected to the path is switched on, while other transistors M2~M4 electrically connected to the upper path are switched off. On the other hand, the lower path of the phase switch circuit 733*a* is out of connection, and the transistor M5 connected to the path is switched off, while other transistors M6~M8 electrically connected to the path are connected to ground voltage via resistors to ensure that the lower path does not affect the voltages at the nodes Na, Nb.

In the second mode, the phase switch circuit 733*a* selects and conducts the lower path, and the transistor M5 connected to the path is switched on, while other transistors M6~M8 electrically connected to the lower path are switched off. On the other hand, the upper path of the phase switch circuit 733*a* is out of connection, and the transistor M1 connected to the path is switched off, while other transistors M2~M4 electrically connected to the path are connected to ground voltage via resistors to ensure that the upper path does not affect the voltages at the nodes Na, Nc.

In the third mode; the phase switch circuit. 733*a* supports the reflection function and does not conduct connection between the nodes. Therefore, the transistor M1 connected to the upper path and the transistor M5 connected to the lower path are switched off. On the other hand, other transistors M2~M4, M6~M8 are connected to ground voltage via the resistors to ensure that the voltages at the nodes Na, Nb, Nc are not affected.

When the transistors. M1 and M5 are switched off, the reflection input signals Srf_in received by the transceiving circuit 733 includes the first phase input signal Sint_sft1 from the first phase feeding path 737*a* and the second phase input signal Sin_sft2 from the second phase feeding path 737*b*. The first phase input signal Srf_sft1 from the first phase feeding path 737*a* is reflected to generate a first reflection sub-sign al Srf_out1 because of the OFF state of the transistor M1. The second phase input signal Srf_sft2 from the second phase feeding path 737*b* is reflected to generate a second reflection sub-signal Srf_out2 because of the OFF state of the transistor M5. Afterwards, both the first reflection sub-signal Srf_out1 and the second reflection sub-signal Srf_out2 are fed into the first end of the lengthwise edge of the radiation slice to form the reflection output signal Srf_out.

Figure 20B:
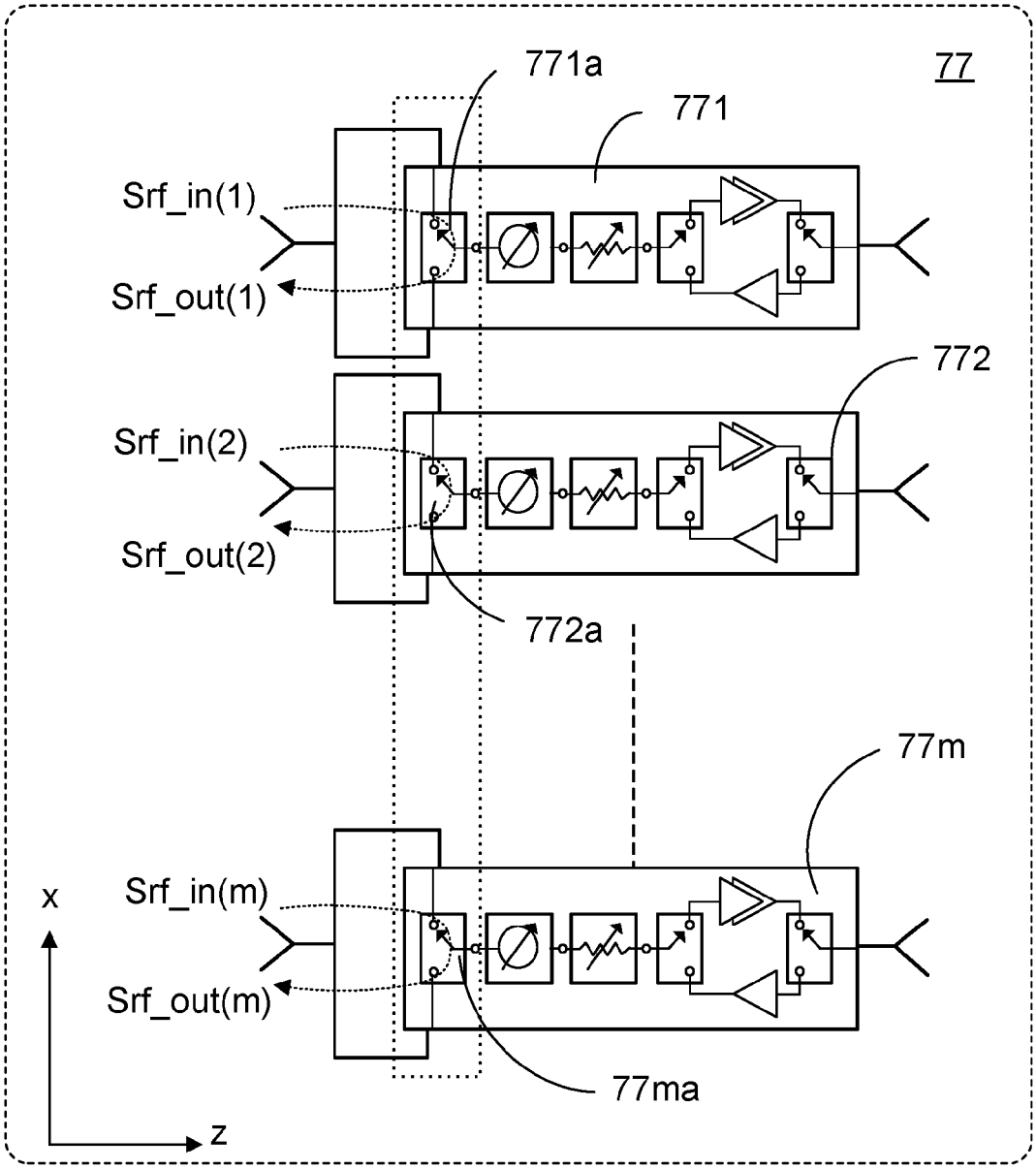
FIG. 20B is a schematic diagram illustrating that the transceiving circuit performs the first type of reflection operation by switching off the phase switch circuit.

Please refer to FIG. 20B, a schematic diagram illustrating that the transceiving circuit generates reflected waves by switching off the phase switch circuit of each transceiving unit of the module. When the transceiving module 77 provides the reflection function with the phase switch circuits, the reflection input signals Srf_in(1)~Srf_in(m) transmitted to the transceiving units 771~77*m* return to the original input ends after arriving the phase switch circuits, and then are transmitted out. The transceiving unit 771 receives the reflection input signal Srf_in(1), and generates the reflection output signal Srf_out(1) through the phase switch circuit 771*a*. The transceiving unit 772 receives the reflection input signal Srf_in(2), and generates the reflection output signal Srf_out(2) through the phase switch circuit 772*a*. The transceiving unit 77*m* receives the reflection input signal Srf_in(m), and generates the reflection output signal Srf_out(m) through the phase switch circuit 77*ma*.

Because each transceiving unit generates the reflection output signal Srf_out immediately after receiving the reflection input signal Srf_in, the reflection signals generated by the transceiving units of the transceiving module have the same phase and strength. Therefore, the reflection signals Srf_in(1), Srf_in(2), Srf_in(m) in FIG. 20B have the same phase shift.

Figure 21A:
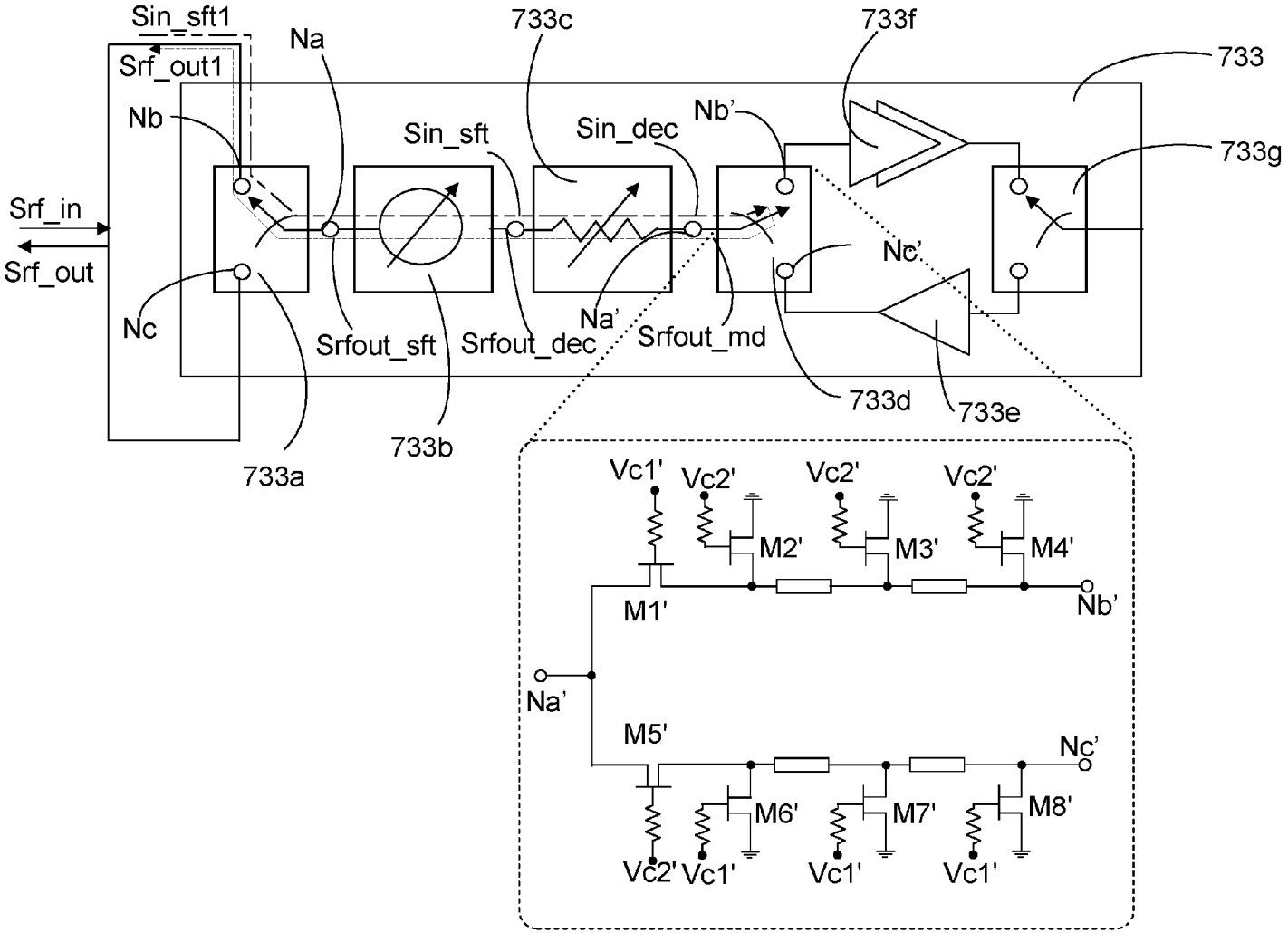
FIG. 21A is a schematic diagram illustrating that the transceiving circuit performs the second type of reflection operation.

Please refer to FIG. 21A, a schematic diagram illustrating that the transceiving circuit performs the second type of reflection operation. For illustration purposes, it is assumed that the phase switch circuit 733*a* conducts the connection between the first phase feeding path 737*a* and the phase shifter 733*b*, and the reflection operation is performed on the first phase input signal Sin_sft1 fed from the first phase feeding path 737*a*. In practice, the phase switch circuit 733*a* may conduct the connection between the second phase feeding path 737*b* and the phase shifter 733*b*, and the reflection operation is performed on the second phase input signal Sin_sft2 fed from the second phase feeding path 737*b*.

The functional switch circuit 733*d* is connected to the attenuator 733*c*, the transmitting amplifier 733*f* and the low noise amplifier 733*e* through the nodes Na', Nb' and Nc'. An enlarged drawing of the functional switch circuit 733*d* is shown at the bottom of FIG. 21A. Transistors M1'~M4' are provided between the nodes Na' and Nb' at the upper path; transistors M5'~M8' are provided between the nodes Na' and Nc' at the lower path. The transistors M1' and M6'~M8' are controlled by a third switch control signal (Vc1'), and the transistors M2'~M5' are controlled by a fourth switch control signal (Vc2'). The operation and control of the transistors M1'~M8' of the functional switch circuit 733*d* are similar to those of the transistors M1~M8 of the phase switch circuit 733*a*, and detailed description is not given again. Table 2 shows that the transistors M1'~M8' of the functional switch circuit 733*d* control the connection states between different nodes in response to different operation modes of the transceiving unit 73.

TABLE 2

| Connection between | Transistor | | | | | | | |
|---|---|---|---|---|---|---|---|---|
| nodes | M1' | M2' | M3' | M4' | M5' | M6' | M7' | M8' |
| Na', Nb' | ON | OFF | OFF | OFF | OFF | ON | ON | ON |
| Na', Nc' | OFF | ON | ON | ON | ON | OFF | OFF | OFF |
| Total reflection | OFF | ON | ON | ON | OFF | ON | ON | ON |

Please refer both the enlarged drawing of the functional switch circuit at the bottom of FIG. 21A and table 2. The first row of table 2 represents that the transceiving unit performs the transmission operation. When the transmission performs the transmission operation, the controller supplies the third switch control signal Vc1' at high level and the fourth switch control signal Vc2' at low level to the functional switch circuit 733*d*. Therefore, the transistors M1', M6'~M8' are switched on and the transistors M2'~M5' are switched off. At this time, the functional switch circuit 733*d* selects the connection between the nodes Na' and Nb'. Hence, the transceiving module generates the external transmission signal Sext_tr with the transmitting amplifier 733*f*, and radiately transmits the external transmission signal Sext_tr out from the second end of the radiation slice.

The second row of table 2 represents that the transceiving unit performs the reception operation. When the transceiving unit performs the reception operation, the controller supplies the third switch control signal Vc1' at low level and the fourth switch control signal Vc2' at high level to the functional switch circuit 733*d*. Therefore, the transistors M1, M6'~M8' are switched off and the transistors M2'~M5' are switched on. At this time, the functional switch circuit 733*d* selects the connection between the nodes Na' and Nc'. Hence, the transceiving unit receives the external reception signal Sext_rv with the low noise amplifier 733*e*, and generates and radiately transmits the internal reception signal Sint_rv out from the first end of the radiation slice.

The third row of table 2 represents that the transceiving unit performs the reflection operation. When the transceiving unit performs the reflection operation, the controller supplies the third switch control signal Vc1' at low level and the fourth switch control signal Vc2' at low level to the functional switch circuit 733*d*. Therefore, the transistors M1, M5' are switched off and the transistors M2'~M4', M6'~M8' are switched on. At this time, the reflection input signal entering the transceiving unit is fed into the transceiving circuit from the first end of the radiation slice, and then the transceiving circuit generates the reflection output signal.

As shown in FIG. 21A, the first phase input signal Sin_sft1 is generated after the first phase feeding path 737*a* feeds the reflection input signal Srf_in. The phase shifter 733*b* receives the first phase input signal Sin_sft1 through the phase switch circuit, and then the phase shift is introduced to the first phase input signal Sin_sft1 to generate the shifted input signal Sin_sft. The attenuator 733*c* adjusts the strength of the shifted input signal Sin_sft to generate the attenuated input signal Sin_dec.

The attenuated input signal Sin_dec is reflected at the node Na' between the attenuator 733*c* and the functional switch circuit 733*d* to generate an intermediate reflection signal Srfout_md. In response to the intermediate reflection signal Srfout_md, the attenuator 733*c* generates an attenuated reflection signal Srfout_dec. Then, in response to the attenuated reflection signal Srfout_dec, the phase shifter 733*b* generates a shifted reflection signal Srfout_sft. The first phase feeding path 737*a* generates the reflection output signal Srf_out according to the shifted reflection signal Srfout_sft.

Figure 21B:
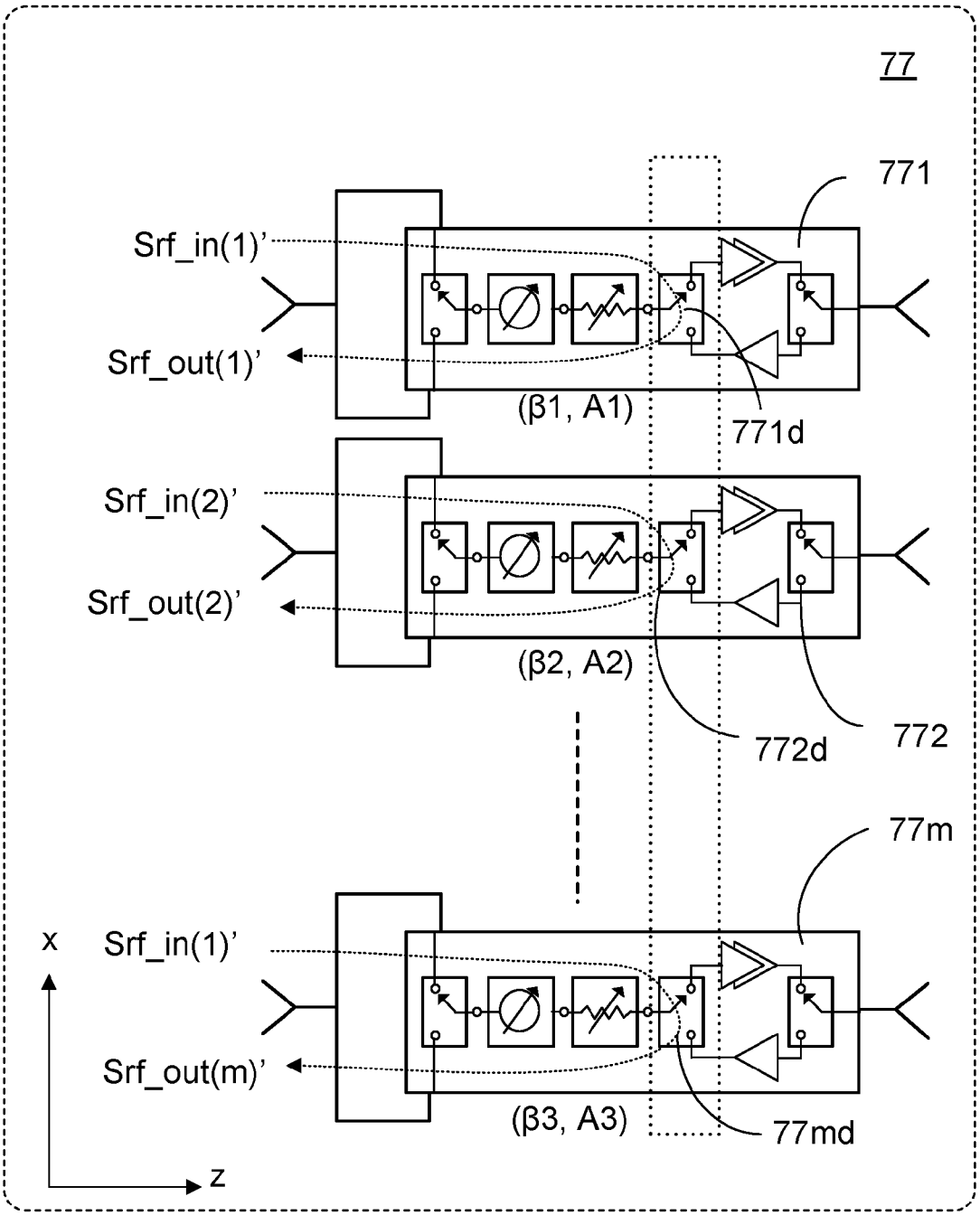
FIG. 21B is a schematic diagram illustrating that the transceiving circuit performs the second type of reflection operation by switching off the functional switch circuit.

Please refer to FIG. 21B, a schematic diagram illustrating that the transceiving circuit generates reflected waves by switching off the functional switch circuit of each transceiving unit of the module. When the transceiving units provide the reflection function with the functional switch circuits, the reflection input signals Srf_in' transmitted to the transceiving units return to the original input ends after arriving the functional switch circuits, and then the reflection output signals Srf_out' are transmitted out.

The transceiving unit 771 receives the reflection input signal Srf_in(1)', and then generates the reflection output signal Srf_out(1)' through the functional switch circuit 771*d*. The transceiving unit 771 uses the phase shifter to introduce the phase delay β1 to the reflection output signal Srf_out(1) and uses the attenuator to provide gain adjustment A1 to the reflection output signal. Other transceiving units perform similar operation to the reflection input signal Srf_in(1)'.

Because the reflection input signals Srf_in(1)'~Srf_in(m)' received by respective transceiving units will be adjusted by the phase shifters and the attenuators, the reflection output signals generated by the transceiving units of the transceiving module may have different phases and strength. Therefore, the reflection output signals Srf_out(1)'~Srf_out(m)' in FIG. 21B may have inconsistent phases and strength.

The difference between the two types of reflection operation is that the reflection signal is generated by switching off the phase switch circuit 733*a* in FIG. 20A and FIG. 20B, and the reflection signal is generated by switching off the functional switch circuit 733*d* in FIG. 21A and FIG. 21B. In FIG. 20A and FIG. 20B, the transmission of the reflection input signal and the reflection output signal does not pass the phase shifter 733*b* and the attenuator 733*c*. On the other hand, the phase shifter 733*b* and the attenuator 733*c* affect the transmission of the reflection input signal and the reflection output signal according to the method with reference to FIG. 21A and FIG. 21B.

By the ways, the phase shifter 733*b* and the attenuator 733*c* affect the reflection input signal and the reflection output signal by the same amount. For example, if the reflection input signal has an initial phase 0°, and the phase shifter 733*b* introduces a phase shift of 20° to the reflection input signal. Thus, the reflection output signal transmitted out from the phase shifter 733*b* has a phase shift of 40°. The gain adjustment provided by the attenuator for the reflection input signal and the reflection output signal results in similar effect. Therefore, the controller can control the phase shifter 733*b* and the attenuator 733*c* to adjust the transmission direction of the reflection signal generated form the reflection operation.

As described above, the control of the present disclosure control multiple transceiving modules wherein each transceiving module includes a plurality of transceiving units. Each transceiving unit includes components such as the phase switch circuit, the phase shifter, the attenuator, the functional switch circuit, the transmitting amplifier and the low noise amplifier which are controlled by the controller.

Figure 22:
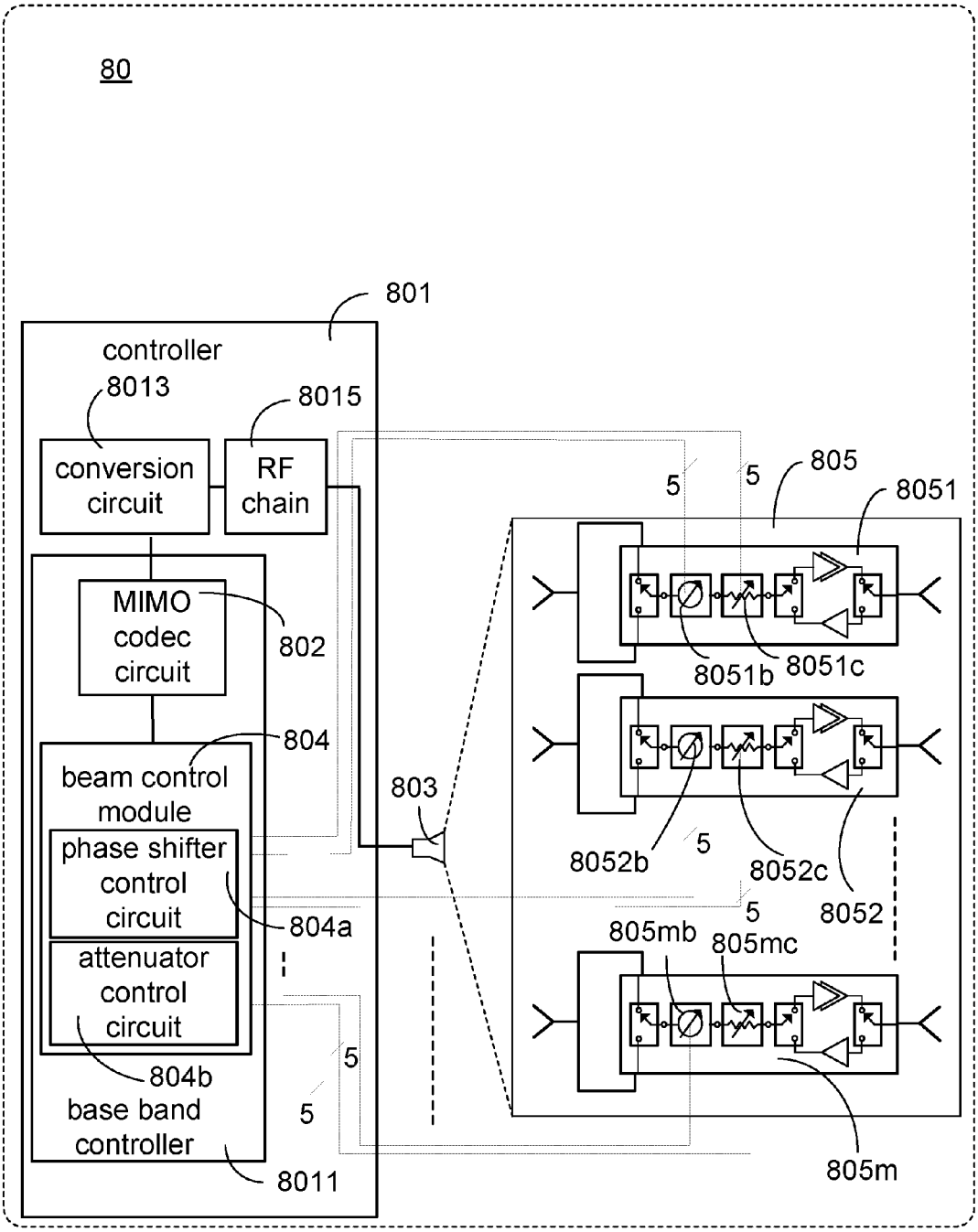
FIG. 22 is a schematic diagram illustrating that the beam controller controls the transceiving units of the transceiving module.

Please refer to FIG. 22, a schematic diagram illustrating that the beam controller controls the transceiving units of the transceiving module. For illustration purposes, one feeding antenna 803 and one transceiving module 805 are shown in the embodiment. The I/O codec circuit 802 of the base band processor 8011 generates the transmission data which are transmitted through the conversion circuit 8013, the radio frequency chain 8015 and the feeding antenna 803. On the other hand, the beam control module 804 of the base band processor 8011 generates module control signals to the multiple transceiving units 8051~805*m* of the transceiving module 805.

As described above, each of transceiving unit 8051~805*m* of the transceiving module 805 includes the phase shifter 8051*b*~805*mb* and the attenuator 8051*c*-805*mc* for introducing various phase settings (β) and gain settings (A). Therefore, the phase shifter control circuit 804*a* generates module control signals corresponding to the phase settings to the phase shifters 8051*b*~805*mb*. The attenuator control circuit 804*b* generates module control signals corresponding to the gain settings to the attenuators 8051*c*~805*mc*.

It is assumed that each of transceiving unit 8051~805*m* supports 32 phase settings and 32 attenuation settings. Therefore, each of transceiving unit 8051~805*m* should receive 10-bit data from the controller 801 to set the phase shifter 8051*b*~805*mb* and the attenuator 8051*c*~805*ac*. As described above, the controller should generate many module control signals to respective transceiving modules. Because the number of connecting lines for the controller is limited, the present disclosure further provide a concept of use of the conversion module to reduce the signal lines for the controller to control the phase shifters 8051*b*~805*mb* and the attenuators 8051*c*~805*mc*.

Figure 23:
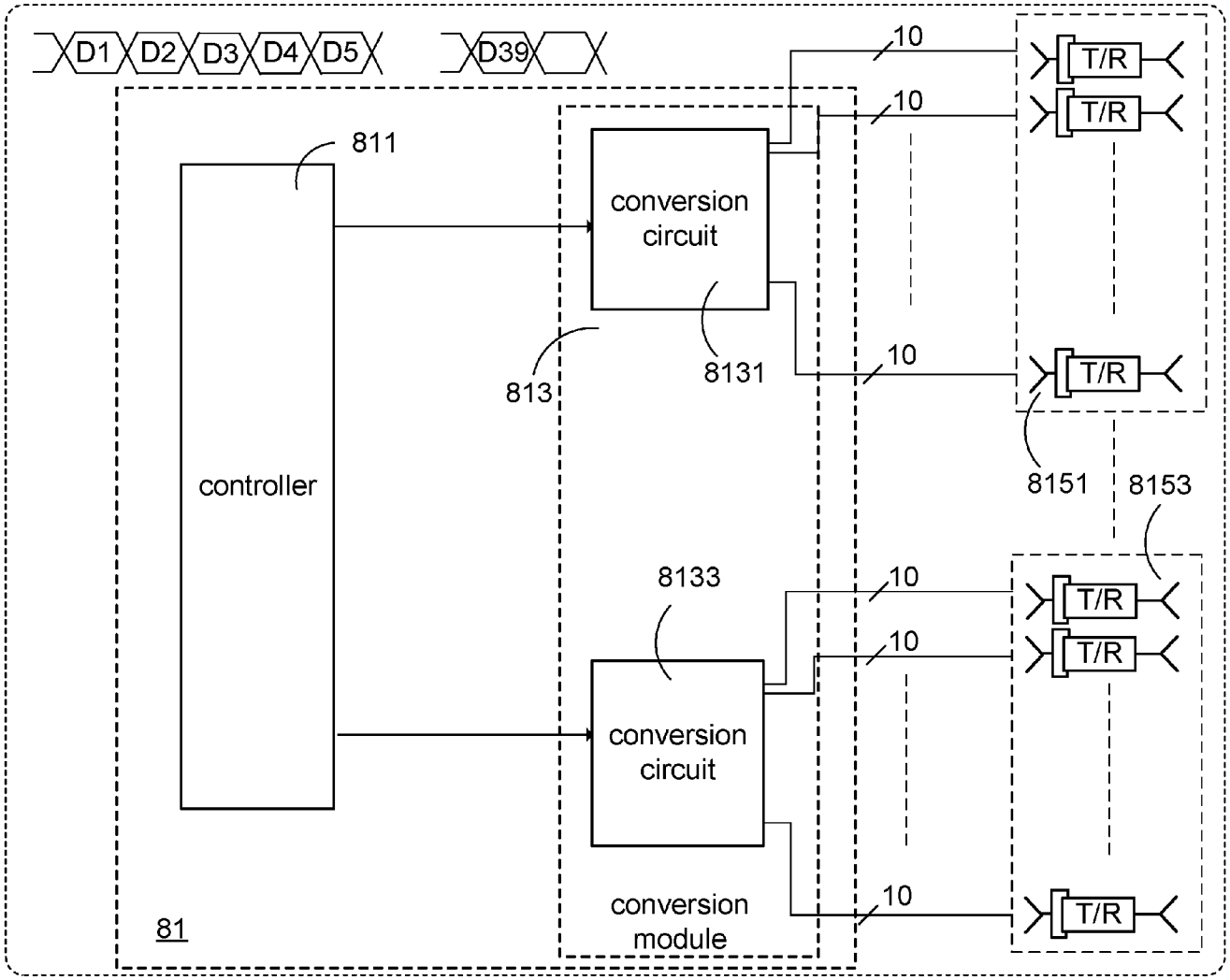
FIG. 23 is a schematic diagram illustrating that the control signals associated with the beam directions are transmitted to the transceiving module by serial transmission.
Figure 24:
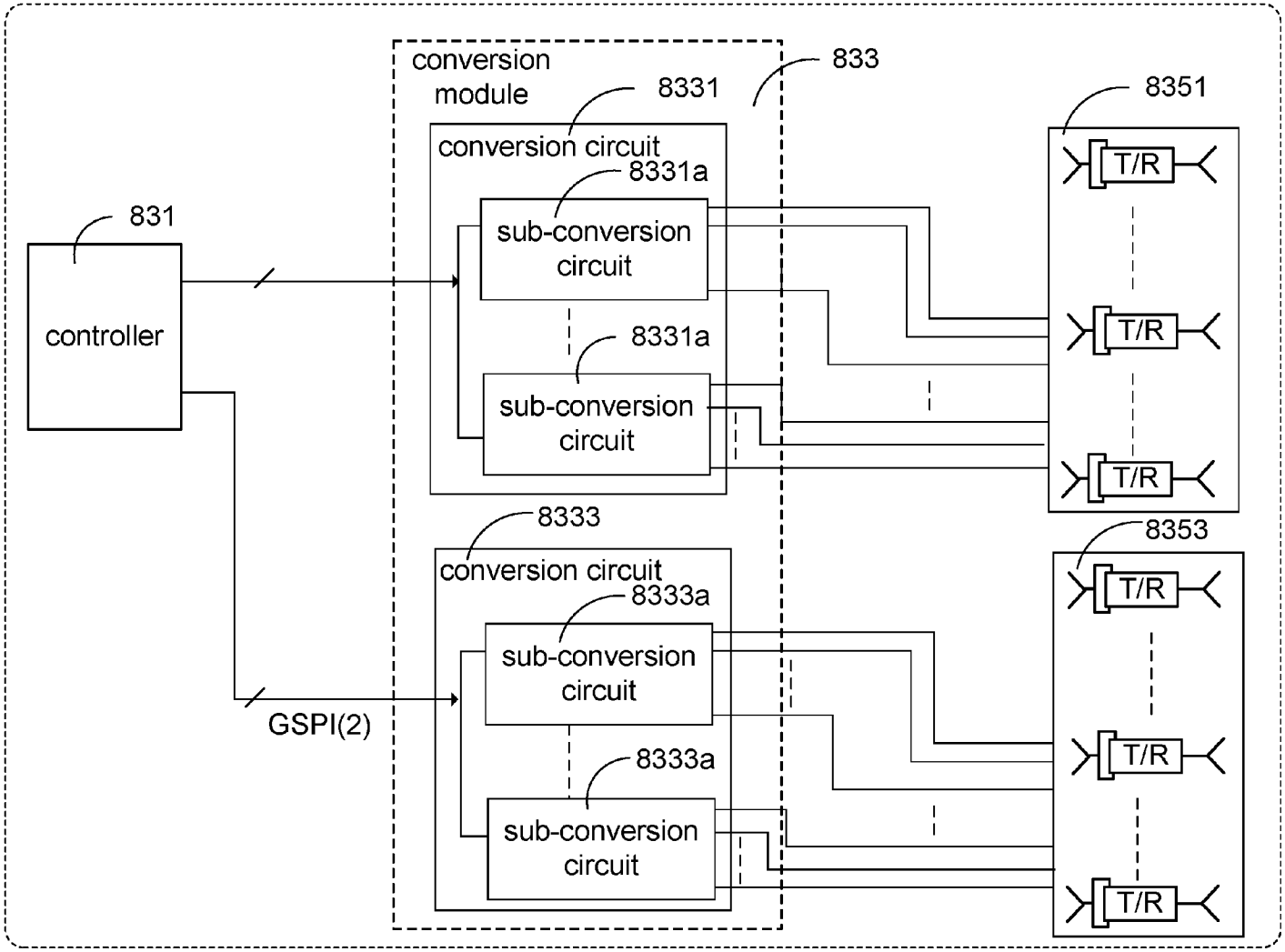
FIG. 24 is a schematic diagram illustrating that a conversion circuit is divided into multiple sub-conversion circuits.
Figure 25:
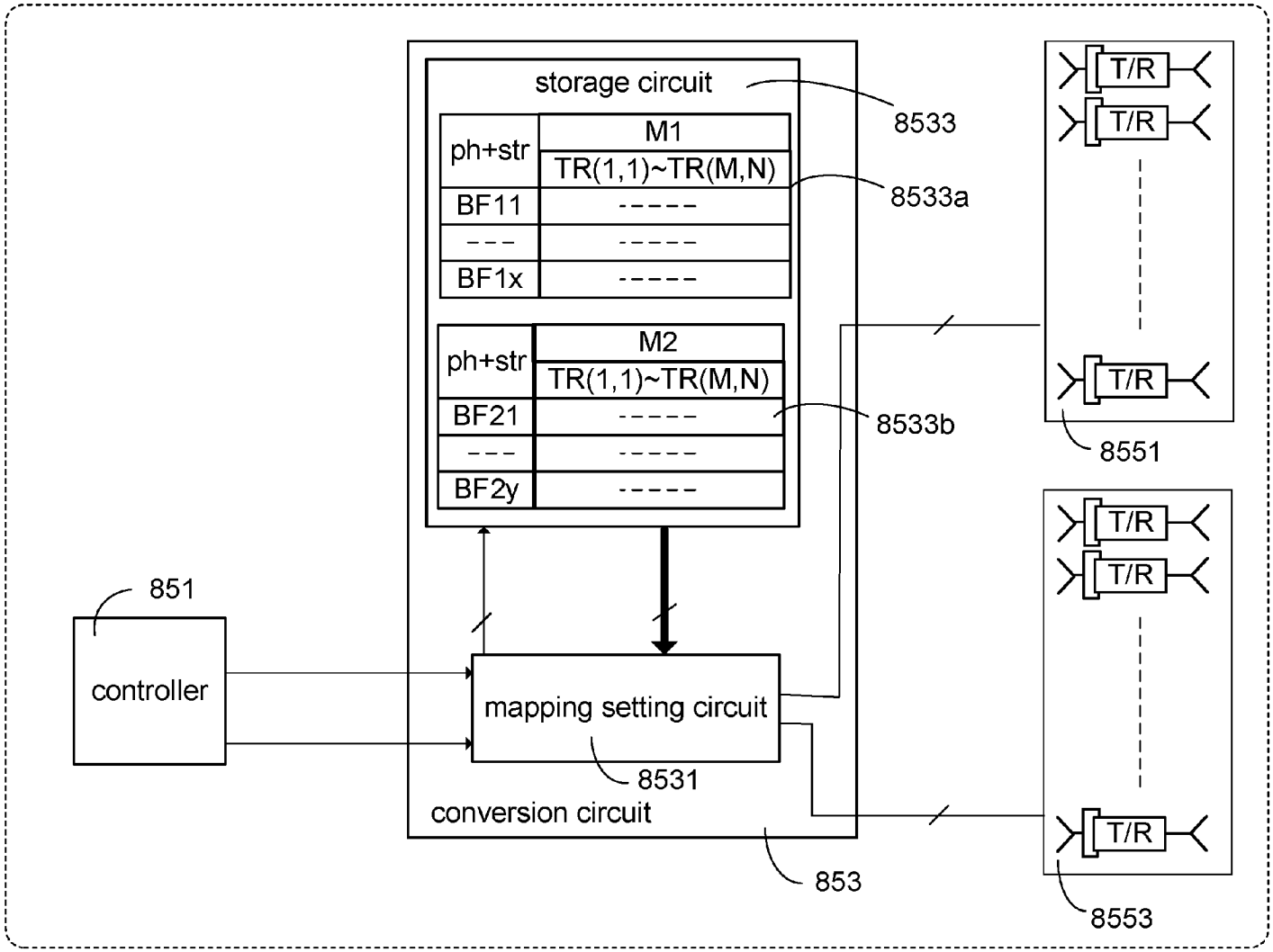
FIG. 25 is a schematic diagram illustrating that a beam lookup table is preloaded and setting parameters in the beam lookup table are selected for transmission.

The conversion module further includes a plurality of conversion circuits. The number of the conversion module is not limited. Generally speaking, the number of the conversion circuits included in the conversion module is equal to the number of the transceiving modules. According to the embodiments of the present disclosure, the number of the connecting lines for the controller may be reduced by modifying the conversion module as shown in FIGS. 23~25. These schemes may be independently used or arbitrarily combined.

In the following description, it is assumed that the beam controller and the conversion module transmit signals through a serial peripheral interface (SPI), but there is no restriction in practice. For illustration purposes, one signal line corresponds to one set of SPI signals.

Please refer to FIG. 23, a schematic diagram illustrating that the module control signals associated with the phase shifters and the attenuators are transmitted by serial transmission. The controller 811 transmits the phase settings and the gain settings corresponding to the phase shifters and the attenuators of the transceiving modules 8151, 8153 in the form of the module control signals to the conversion module 813 by serial transmission. Then, the conversion circuits 8131, 8133 of the conversion module 813 performs transformation of serial to parallel. The conversion circuit 8131 transmits the transformed phase settings and gain settings to the transceiving module 8151. The conversion circuit 8133 transmits the transformed phase settings and gain settings to the transceiving module 8153.

Please refer to FIG. 24, a schematic diagram illustrating that a conversion circuit is divided into multiple sub-conversion circuits. Each conversion circuit 8331, 8333 includes a plurality of sub-conversion circuits 8331*a*, 8333*a*. The conversion circuit 8331 receives the module control signals corresponding to the transceiving module 8351 from the controller 831, and then the sub-conversion circuits 8331*a* perform decoding or mapping transformation. The conversion circuit 8333 receives the module control signals corresponding to the transceiving module 8353 from the controller 831, and then the sub-conversion circuits 8333*a* perform decoding or mapping transformation. In brief, this scheme provides multi-to-multi signal transformation function.

Please refer to FIG. 25, a schematic diagram illustrating that a beam lookup table is preloaded and setting parameters in the beam lookup table are selected for transmission. The conversion circuit 853 includes a storage circuit 8533 and a mapping setting circuit 8531 electrically connected to each other. The mapping setting circuit is also electrically connected to the controller 851 and each transceiving module 8551, 8553. The storage circuit 8533 stores the beam lookup table. The beam lookup table records a plurality of beam parameters corresponding to each transceiving module (M1, M2) and a plurality of phase and gain settings corresponding to the beam parameters. For example, the beam lookup table 8533*a* records many sets of setting parameters corresponding to the transceiving module 8551 (i.e. the first transceiving module M1); the beam lookup table 8533*b* records many sets of setting parameters corresponding to the transceiving module 8553 (i.e. the second transceiving module M2).

Taking the beam lookup table 8533*a* as an example, it defines how to set the phase shifter (ph) and the gain adjustment (str) of the attenuator of each transceiving unit TR(1,1)~TR(M,N) when the transceiving module 8551 generates the beam BF11~BF1*x*.

Accordingly, when the mapping setting circuit 8531 receives the beam parameter BFx form the controller 851, the mapping setting circuit 8531 looks up the beam lookup table to find out a set of selected phase settings and a set of selected gain settings corresponding to the selected beam parameter (BFx). After the mapping setting circuit 8531 finds out the set of selected phase and gain settings, the selected phase and gain settings are used as first adjusting parameters for adjusting the first transceiving module M1. Similarly, for different transceiving modules 8551, 8553, the mapping setting circuit 8531 receives the selected beam parameters corresponding to the transceiving modules 8551, 8553 from the controller. Then, the mapping setting circuit 8531 obtains the adjusting parameters from the beam lookup table in the storage circuit 8533.

Therefore, the controller 851 only informs the conversion circuit 853 how to select the beam type corresponding to the transceiving modules. For example, if the controller supports 10 transceiving modules each of which involves 32 beam types, the selected beam parameters transmitted between the controller 851 and the conversion circuit 853 only contain 320 combinations. In this embodiment, 9 bits are enough. Furthermore, because the storage circuit 8533 has preloaded the beam lookup table, no additional time is required for the controller 851 to transmit the phase settings and the gain settings so that the beam generation time is significantly reduced. Hence, the scheme in FIG. 25 has effects of reducing output lines for the controller 851 and rapid switching the beam direction.

It should be noted that the schemes for reducing the connecting lines as shown in FIGS. 23~25 may be combined. The combination of the schemes in FIGS. 23~25 may be determined according to real requirements of the communication device or the available connecting lines for the controller, and detailed description is not given again.

Figure 26:
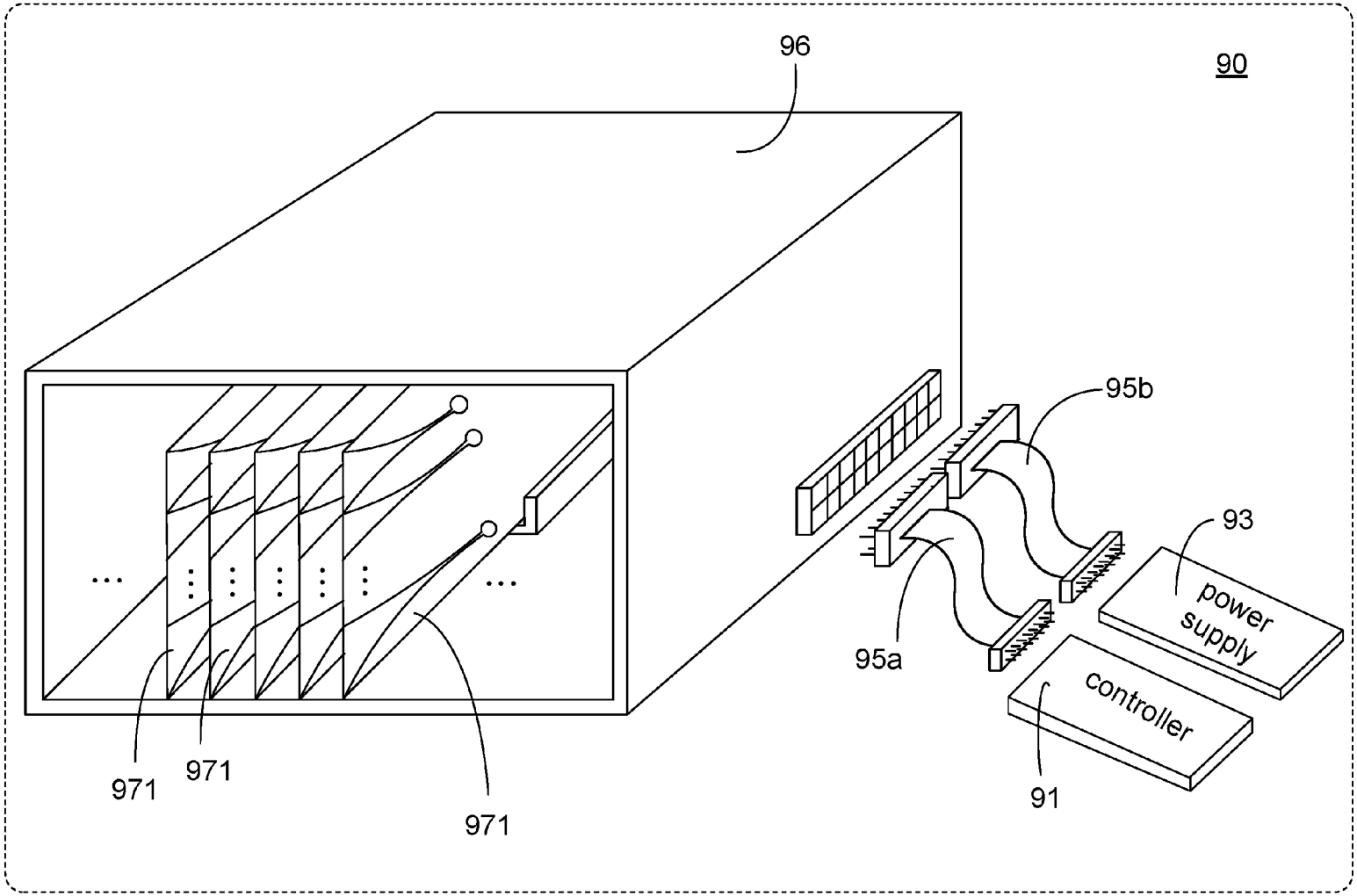
FIG. 26 is a schematic diagram illustrating that the transceiving module is disposed in a case and connected to the beam processing circuit through a cable.

Please refer to FIG. 26, a schematic diagram illustrating that the transceiving module is disposed in a case and receives the module control signals from the controller through a cable. In this diagram, it is assumed that the communication device 90 includes only one transceiving module. The parallel transceiving units 971 of the transceiving module are disposed in the case 96. The transceiving units 971 are arranged in multiple parallel layers. The feeding antenna is disposed at the back side of the case 96. The inner lateral side of the transceiving module is positioned near the back side of the case 96, and the outer lateral side of the transceiving module is positioned near the front side of the case 96. The transceiving module is electrically connected to the controller 91 and a power supply 93 through the cables 95*a*, 95*b*, respectively.

Because the transceiving module is disposed in the case 96 as shown in FIG. 26, the communication device may use a plurality of transceiving modules contained in respective cases for different applications. Arranging the transceiving module in the case can make arrangement of multiple transceiving modules more flexible. The communication device according to the concepts of the present disclosure can use various number of transceiving modules according to the installation space and the communication quality.

As described above, multiple transceiving units are disposed in each transceiving module of the communication device according to the present disclosure so that lower power amplifiers are applicable. Thus, the communication device requires lower DC power so that it is advantageous to heat dispersion and dissipation. Furthermore, the number and the arrangement of the transceiving modules in the communication device may be adjusted to meet real requirements. Because of wireless signal transmission and reception between the feeding antenna and the inner lateral side of the transceiving modules, the complexity of controlling the transceiving modules by the controller decreases. In addition, the controller of the present disclosure may be used with the conversion module to reduce the connecting lines for the controller.

In conclusion, although the present invention has been disclosed in above preferred embodiments, it is not intended to limit the present invention. For those skilled in the art, various modifications and variations can be made within the spirit and scope of the present invention. Therefore, a true scope of the present invention is indicated by the following claims.

What is claimed is:

1. A transmitting device, comprising:

at least a feeding antenna for radiately transmitting at least an internal transmission signal;

a controller electrically connected to the at least a feeding antenna, for generating a plurality of first module control signals and a plurality of second module control signals, and feeding the at least an internal transmission signal into the at least a feeding antenna;

a first transceiving module electrically connected to the controller, for performing first transmission operation in response to the first module control signals, wherein the first transceiving module comprises:

a first inner lateral side;

a first outer lateral side parallel to the first inner lateral side wherein a distance between the first inner lateral side and the at least a feeding antenna is shorter than a distance between the first outer lateral side and the at least a feeding antenna; and a plurality of first transceiving units, each of the first transceiving units comprising:

a first radiation slice having a first lengthwise edge, wherein a first end and a second end of the first lengthwise edge are toward the first inner lateral side and the first outer lateral side, respectively, and the first radiation slice radiately receives the at least an internal transmission signal at the first end of the first lengthwise edge; and a first transceiving circuit disposed on the first radiation slice and electrically connected to the controller, wherein the first transceiving circuit receives the at least an internal transmission signal from the first radiation slice, generates a first external transmission signal according to the at least an internal transmission signal and radiately transmits the first external transmission signal through the second end of the first lengthwise edge of the first radiation slice; and a second transceiving module electrically connected to the controller, for performing one of second transmission operation and reflection operation in response to the second module control signals, wherein the second transceiving module comprises:

a second inner lateral side;

a second outer lateral side parallel to the second inner lateral side wherein a distance between the second inner lateral side and the at least a feeding antenna is shorter than a distance between the second outer lateral side and the at least a feeding antenna; and a plurality of second transceiving units, each of the second transceiving units comprising:

a second radiation slice having a second lengthwise edge equal in length to the first lengthwise edge, wherein a first end and a second end of the second lengthwise edge are toward the second inner lateral side and the second outer lateral side, respectively, and the second radiation slice radiately receives the at least an internal transmission signal at the first end of the second lengthwise edge; and a second transceiving circuit disposed on the second radiation slice and electrically connected to the controller, for receiving the at least an internal transmission signal from the second radiation slice.

2. The transmitting device according to claim 1, wherein when the second transceiving module performs the second transmission operation, the second transceiving circuit performs transmitting-transformation of the at least an internal transmission signal to generate a second external transmission signal, and the second radiation slice radiately transmits the second external transmission signal at the second end of the second lengthwise edge; and when the second transceiving module performs the reflection operation, the second transceiving circuit generates a reflection output signal according to the at least an internal transmission signal, and the second radiation slice radiately transmits the reflection output signal at the first end of the second lengthwise edge.

3. The transmitting device according to claim 2, wherein when the second transceiving module performs the reflection operation, the first radiation slice radiately receives the reflection output signal at the first end of the first lengthwise edge.

4. The transmitting device according to claim 2, wherein the second transceiving circuit comprises:

a first phase feeding path electrically connected to the second radiation slice, for receiving the at least an internal transmission signal from the second radiation slice and generating a first phase input signal;

a second phase feeding path electrically connected to the second radiation slice, for receiving the at least an internal transmission signal from the second radiation slice and generating a second phase input signal, wherein the first phase input signal and the second phase input signal are opposite signals;

a phase shifter for selectively introducing a phase shift to one of the first phase input signal and the second phase input signal, and generating a shifted input signal; and a phase switch circuit, comprising:

a first selector switch having one end electrically connected to the phase shifter and the other end electrically connected to the first phase feeding path, for selectively conducting connection between the phase shifter and the first phase feeding path according to a level of a first switch control signal; and a second selector switch having one end electrically connected to the phase shifter and the other end electrically connected to the second phase feeding path, for selectively conducting connection between the phase shifter and the second phase feeding path according to a level of a second switch control signal.

5. The transmitting device according to claim 4, wherein when the second transceiving module performs the reflection operation, the first selector switch and the second selector switch are switched off, wherein after the first phase feeding path transmits the first phase input signal to the first selector switch, the first phase input signal is reflected to generate a first reflection sub-signal because the first selector switch is switched off, and after the second phase feeding path transmits the second phase input signal to the second selector switch, the second phase input signal is reflected to generate a second reflection sub-signal because the second selector switch is switched off, wherein the first reflection sub-signal and the second reflection sub-signal are fed into the first end of the second lengthwise edge of the second radiation slice to form the reflection output signal.

6. The transmitting device according to claim 4, wherein one of the first selector switch and the second selector switch is switched on, and the other of the selector switches is switched off, wherein when the first selector switch is switched on and the second selector switch is switched off, the phase shifter introduces the phase shift to the first phase input signal to generate the shifted input signal; and when the first selector switch is switched off and the second selector switch is switched on, the phase shifter introduces the phase shift to the second phase input signal to generate the shifted input signal.

7. The transmitting device according to claim 6, wherein the second transceiving circuit further comprises:

an attenuator electrically connected to the phase shifter, for adjusting strength of the shifted input signal to generate an attenuated input signal;

a transmitting amplifier selectively electrically connected to the second radiation slice;

a low noise amplifier selectively electrically connected to the second radiation slice;

a first functional switch circuit, comprising:

a third selector switch having one end electrically connected to the attenuator and the other end electrically connected to the transmitting amplifier, for selectively conducting connection between the attenuator and the transmitting amplifier according to a level of a third switch control signal; and a fourth selector switch having one end electrically connected to the attenuator and the other end electrically connected to the low noise amplifier, for selectively conducting connection between the attenuator and the low noise amplifier according to a level of a fourth switch control signal; and a second functional switch circuit, comprising:

a fifth selector switch having one end electrically connected to the second end of the second lengthwise edge of the second radiation slice and the other end electrically connected to the transmitting amplifier, wherein the third selector switch and the fifth selector switch are simultaneously switched on or switched off; and a sixth selector switch having one end electrically connected to the second end of the second lengthwise edge of the second radiation slice and the other end electrically connected to the low noise amplifier, wherein the fourth selector switch and the sixth selector switch are simultaneously switched on or switched off.

8. The transmitting device according to claim 7, wherein when the second transceiving module performs the second transmission operation, the third selector switch is switched on and the fourth selector switch is switched off, wherein the transmitting amplifier adjusts strength of the attenuated input signal to generate the second external transmission signal.

9. The transmitting device according to claim 7, wherein when the second transceiving module performs the reflection operation, the third selector switch and the fourth selector switch are switched off, wherein the attenuated input signal is reflected to generate an intermediate reflection signal because the third selector switch and the fourth selector switch are switched off, wherein the reflection output signal is generated from the intermediate reflection signal through the first selector switch and the first phase feeding path, or the reflection output signal is generated from the intermediate reflection signal through the second selector switch and the second phase feeding path.

10. The transmitting device according to claim 2, wherein the at least a feeding antenna comprises a first feeding antenna and a second feeding antenna, and the at least an internal transmission signal comprises a first internal transmission signal and a second internal transmission signal, wherein the controller feeds the first internal transmission signal and the second internal transmission signal into the first feeding antenna and the second feeding antenna, respectively.

11. The transmitting device according to claim 10, wherein the first external transmission signal and the second external transmission signal correspond to a first receiving device; or the first external transmission signal and the second external transmission signal correspond to a second receiving device and a third receiving device, respectively.

12. The transmitting device according to claim 1, wherein the first transceiving units are arranged in M columns and N rows, and the controller adjusts the first module control signals according to the positions of the first transceiving units relative to a center of the first transceiving module and a predetermined transmission direction of the first external transmission signal.

13. The transmitting device according to claim 1, further comprising:

a conversion module electrically connected to the controller, the first transceiving module and the second transceiving module, wherein the conversion modules receives the first module control signals and the second module control signals from the controller, wherein the conversion module transforms the first module control signals into a plurality of sets of first adjusting parameters, and transmits the sets of first adjusting parameters to the first transceiving module, wherein the number of signal lines for transmission of the first module control signals is less than the number of signal lines for transmission of the sets of first adjusting parameters, and the conversion module transforms the second module control signals into a plurality of sets of second adjusting parameters, and transmits the sets of second adjusting parameters to the second transceiving module, wherein the number of signal lines for transmission of the second module control signals is less than the number of signal lines for transmission of the sets of second adjusting parameters.

14. The transmitting device according to claim 13, wherein the controller transmits the first module control signals to the conversion module by serial transmission, and the conversion module transmits the sets of first adjusting parameters to the first transceiving module by parallel transmission.

15. The transmitting device according to claim 13, wherein the conversion module comprises a plurality of conversion circuits, and a first conversion circuit of the conversion circuits comprises a plurality of sub-conversion circuits, wherein each of the sub-conversion circuits transforms a portion of the first module control signals into a portion of the sets of first adjusting parameters.

16. The transmitting device according to claim 13, wherein the conversion module comprises:

a storage circuit for storing a beam lookup table, wherein the beam lookup table records a plurality of beam parameters and a plurality of sets of phase and gain settings corresponding to the beam parameters; and a mapping setting circuit electrically connected to the storage circuit and the controller, for receiving the first module control signals representing a selected beam parameter, and finding out a set of selected phase and gain setting corresponding to the selected beam parameter from the beam lookup table, wherein the mapping setting circuit uses the set of selected phase and gain setting as the sets of first adjusting parameters.

17. The transmitting device according to claim 1, wherein the first radiation slice and the second radiation slice are made of a conductive material, and each of the first end and the second end of the first lengthwise edge of the first radiation slice and the first end and the second end of the second lengthwise edge of the second radiation slice has a tapered slot antenna structure, wherein an included angle is formed between the first inner lateral side and the second inner lateral side, and the included angle ranges from 0° to 180°.

18. A receiving device, comprising:

at least a feeding antenna for radiately receiving a first internal reception signal and a second internal reception signal;

a controller electrically connected to the at least a feeding antenna, for generating a plurality of first module control signals and a plurality of second module control signals, and receiving the first internal reception signal and the second internal reception signal from the at least a feeding antenna;

a first transceiving module electrically connected to the controller, for performing first reception operation in response to the first module control signals, wherein the first transceiving module comprises:

a first inner lateral side;

a first outer lateral side parallel to the first inner lateral side wherein a distance between the first inner lateral side and the at least a feeding antenna is shorter than a distance between the first outer lateral side and the at least a feeding antenna; and a plurality of first transceiving units, each of the first transceiving units comprising:

a first radiation slice having a first lengthwise edge, wherein a first end and a second end of the first lengthwise edge are toward the first inner lateral side and the first outer lateral side, respectively, and the first radiation slice radiately receives a first external reception signal at the second end of the first lengthwise edge; and a first transceiving circuit disposed on the first radiation slice and electrically connected to the controller, wherein the first transceiving circuit receives the first external reception signal from the first radiation slice, generates the first internal reception signal according to the first external reception signal and radiately transmits the first internal reception signal through the first end of the first lengthwise edge of the first radiation slice; and a second transceiving module electrically connected to the controller, for performing one of second reception operation and reflection operation in response to the second module control signals, wherein the second transceiving module comprises:

a second inner lateral side;

a second outer lateral side parallel to the second inner lateral side wherein a distance between the second inner lateral side and the at least a feeding antenna is shorter than a distance between the second outer lateral side and the at least a feeding antenna; and a plurality of second transceiving units, each of the second transceiving units comprising:

a second radiation slice having a second lengthwise edge equal in length to the first lengthwise edge, wherein a first end and a second end of the second lengthwise edge are toward the second inner lateral side and the second outer lateral side, respectively, and the second radiation slice radiately transmits the second internal reception signal at the first end of the second lengthwise edge; and a second transceiving circuit disposed on the second radiation slice and electrically connected to the controller, wherein the second transceiving circuit feeds the second internal reception signal into the second radiation slice.

19. The receiving device according to claim 18, wherein when the second transceiving module performs the second reception operation, the second radiation slice radiately receives a second external reception signal at the second end of the second lengthwise edge, and the second transceiving circuit performs receiving-transformation of the second external reception signal to generate the second internal reception signal; and when the second transceiving module performs the reflection operation, the second radiation slice radiately receives a reflection input signal at the first end of the second lengthwise edge, and the second transceiving circuit generates the second internal reception signal according to the reflection input signal.

20. The receiving device according to claim 19, wherein when the second transceiving module performs the reflection operation, the first radiation slice radiately transmits the reflection input signal at the first end of the first lengthwise edge.

* * * * *